US009376643B2

(12) United States Patent
Bredsguard

(10) Patent No.: US 9,376,643 B2
(45) **Date of Patent: *Jun. 28, 2016**

(54) ESTOLIDE COMPOSITIONS EXHIBITING SUPERIOR HIGH-PERFORMANCE PROPERTIES

(71) Applicant: BIOSYNTHETIC TECHNOLOGIES, LLC, Irvine, CA (US)

(72) Inventor: Jakob Bredsguard, Lake Forest, CA (US)

(73) Assignee: Biosynthetic Technologies, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/501,867

(22) Filed: Sep. 30, 2014

(65) Prior Publication Data

US 2015/0094246 A1 Apr. 2, 2015

Related U.S. Application Data

(60) Provisional application No. 61/886,023, filed on Oct. 2, 2013, provisional application No. 61/898,457, filed on Oct. 31, 2013.

(51) Int. Cl.

| | |
|---|---|
| ***C07F 5/04*** | (2006.01) |
| ***C07C 69/34*** | (2006.01) |
| ***C10M 173/02*** | (2006.01) |
| ***C07C 59/147*** | (2006.01) |
| ***C10M 105/34*** | (2006.01) |
| ***C10M 169/04*** | (2006.01) |

(52) U.S. Cl.

CPC ..... *C10M 105/34* (2013.01); *C10M 169/045* (2013.01); *C10M 169/048* (2013.01); *C10M 2203/1025* (2013.01); *C10M 2205/0285* (2013.01); *C10M 2205/04* (2013.01); *C10M 2205/06* (2013.01); *C10M 2209/1023* (2013.01); *C10M 2209/1105* (2013.01); *C10M 2215/06* (2013.01); *C10M 2219/046* (2013.01); *C10N 2210/02* (2013.01); *C10N 2230/02* (2013.01); *C10N 2230/04* (2013.01); *C10N 2230/06* (2013.01); *C10N 2230/64* (2013.01); *C10N 2240/10* (2013.01)

(58) Field of Classification Search

CPC ..... C10M 2207/282; C10N 2210/02; C10G 33/04; C08G 63/06

USPC ..... 508/465, 506; 554/122

See application file for complete search history.

(56) References Cited

U.S. PATENT DOCUMENTS

| | | | | |
|---|---|---|---|---|
| 6,458,173 | B1 | 10/2002 | Lin | |
| 6,774,091 | B2 | 8/2004 | Dituro et al. | |
| 7,214,648 | B2 | 5/2007 | Saini et al. | |
| 8,207,099 | B2 | 6/2012 | Loper | |
| 8,236,194 | B1 * | 8/2012 | Bredsguard | C09K 5/044 252/67 |
| 8,258,326 | B1 * | 9/2012 | Forest | C08K 5/1515 549/512 |
| 8,268,199 | B1 * | 9/2012 | Forest | C10M 105/42 252/570 |
| 8,287,754 | B1 * | 10/2012 | Bredsguard | C09K 5/044 252/68 |
| 8,372,301 | B2 * | 2/2013 | Bredsguard | C10M 169/04 252/68 |
| 8,450,256 | B2 * | 5/2013 | Bredsguard | C07C 69/675 508/465 |
| 8,486,875 | B2 * | 7/2013 | Bredsguard | C07C 69/675 508/465 |
| 8,512,592 | B2 * | 8/2013 | Forest | C10M 105/42 252/67 |
| 8,541,351 | B2 | 9/2013 | Thompson et al. | |
| 8,633,143 | B2 | 1/2014 | Thompson et al. | |
| 8,716,206 | B2 * | 5/2014 | Bredsguard | C07C 69/675 508/465 |
| 8,877,695 | B2 | 11/2014 | Thompson et al. | |
| 2008/0026973 | A1 | 1/2008 | Nelson | |
| 2010/0029523 | A1 | 2/2010 | Benecke et al. | |
| 2012/0083435 | A1 * | 4/2012 | Bredsguard | C07C 69/675 508/496 |
| 2012/0172269 | A1 * | 7/2012 | Greaves | C09K 8/34 508/474 |
| 2012/0322707 | A1 * | 12/2012 | Bredsguard | C10M 169/02 508/465 |
| 2012/0322897 | A1 * | 12/2012 | Bredsguard | C10M 169/04 514/785 |
| 2013/0023454 | A1 * | 1/2013 | Bredsguard | C09K 5/044 508/496 |
| 2013/0065970 | A1 * | 3/2013 | Bredsguard | A61K 8/37 514/785 |
| 2013/0102510 | A1 * | 4/2013 | Thompson | C10M 169/04 508/511 |
| 2013/0172223 | A1 * | 7/2013 | Thompson | C09K 5/044 508/408 |
| 2013/0338050 | A1 * | 12/2013 | Bredsguard | C10M 169/04 508/465 |
| 2013/0340246 | A1 * | 12/2013 | Thompson | C10M 105/42 29/602.1 |
| 2014/0012023 | A1 * | 1/2014 | Thompson | C07C 69/604 554/122 |
| 2014/0142014 | A1 | 5/2014 | Bredsguard | |
| 2015/0005212 | A1 * | 1/2015 | Bredsguard | C07C 69/675 508/465 |
| 2015/0045430 | A1 * | 2/2015 | Parson | A61K 8/37 514/547 |
| 2015/0087569 | A1 | 3/2015 | Forest et al. | |
| 2015/0210950 | A1 * | 7/2015 | Bredsguard | C07C 69/675 508/465 |

FOREIGN PATENT DOCUMENTS

| | | |
|---|---|---|
| WO | 2007128740 | 11/2007 |
| WO | 2012177549 | 12/2012 |

OTHER PUBLICATIONS

International Search Report and Written Opinion for PCT/US2014/058262, mailed Jan. 28, 2015.

(Continued)

*Primary Examiner* — Vishal Vasisth

(74) *Attorney, Agent, or Firm* — Jeremy Forest

(57) ABSTRACT

Compounds and compositions, including engine oils and lubricant formulations comprising at least one estolide compound. Exemplary compositions comprise an estolide base oil and an additive package.

12 Claims, No Drawings

(56) References Cited

OTHER PUBLICATIONS

Notice of Allowance Dated Dec. 3, 2012 for U.S. Appl. No. 13/483,602, filed May 30, 2012.

Notice of Allowance dated Aug. 20, 2012, for U.S. Appl. No. 13/531,923, filed Jun. 25, 2012.

Notice of Allowance dated Dec. 6, 2013, for U.S. Appl. No. 13/754,775, filed Jan. 30, 2013.

Notice of Allowance dated Jul. 19, 2013, for U.S. Appl. No. 13/705,543, filed Dec. 5, 2012.

Office Action Dated Sep. 14, 2012, for U.S. Appl. No. 13/483,602, filed May 30, 2012.

Office Action dated Feb. 13, 2015, for U.S. Appl. No. 13/950,508, filed Jul. 25, 2013.

Office Action dated Mar. 28, 2013, for U.S. Appl. No. 13/705,543, filed Dec. 5, 2012.

Office Action dated Sep. 3, 2013, for U.S. Appl. No. 13/754,775, filed Jan. 30, 2013.

* cited by examiner

ESTOLIDE COMPOSITIONS EXHIBITING SUPERIOR HIGH-PERFORMANCE PROPERTIES

This application claims benefit of 61/886,023, filed Oct. 2, 2013 and claims benefit of 61/898,457, filed Oct. 30, 2013.

FIELD

The present disclosure relates to compositions containing one or more estolide compounds and an additive package. In certain embodiments, the composition is a formulated engine oil.

BACKGROUND

Various types of petroleum-based lubricants suitable for use in engines have been described. Such lubricants often contain a variety of additive components in order for the lubricant to pass industry standard tests to permit use in engines. However, the use of such lubricants may result in the dispersion of such lubricants into waterways, such as rivers, oceans and lakes. The petroleum base stock and additives of common engine lubricant formulations are typically non-biodegradable and can be toxic. Thus, the preparation and use of lubricants comprising biodegradable base oils is desirable and has generated interest by both the environmental community and lubricant manufacturers.

SUMMARY

Described herein are compositions comprising at least one estolide compound, and methods of making the same. In certain embodiments, the composition comprises a composition suitable for use as an engine lubricant. In certain embodiments, the composition comprises an estolide base oil and an additive package. In certain embodiments, the composition comprises:

an additive package; and at least one estolide compound selected from compounds of Formula I:

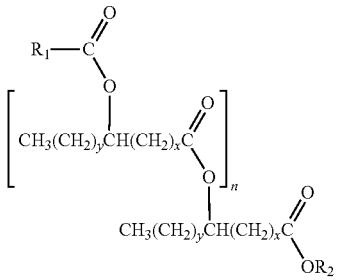

Formula I wherein x is, independently for each occurrence, an integer selected from 0 to 20;

y is, independently for each occurrence, an integer selected from 0 to 20;

n is an integer equal to or greater than 0;

$R_1$ is an optionally substituted alkyl that is saturated or unsaturated, and branched or unbranched; and $R_2$ is selected from hydrogen and optionally substituted alkyl that is saturated or unsaturated, and branched or unbranched;

wherein each fatty acid chain residue of said at least one estolide compound is independently optionally substituted.

In certain embodiments, the composition comprises:

an additive package; and at least one estolide compound selected from compounds of Formula II:

Formula II

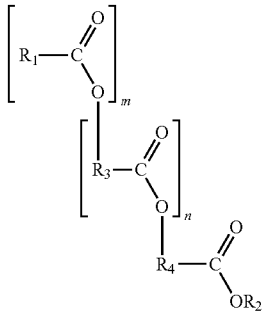

wherein m is an integer equal to or greater than 1;

n is an integer equal to or greater than 0;

$R_1$, independently for each occurrence, is an optionally substituted alkyl that is saturated or unsaturated, and branched or unbranched;

$R_2$ is selected from hydrogen and optionally substituted alkyl that is saturated or unsaturated, and branched or unbranched; and $R_3$ and $R_4$, independently for each occurrence, are selected from optionally substituted alkyl that is saturated or unsaturated, and branched or unbranched.

DETAILED DESCRIPTION

The estolide compositions described herein may exhibit superior oxidative stability when compared to other lubricant and/or estolide-containing compositions. Exemplary compositions include, but are not limited to, coolants, fire-resistant and/or non-flammable fluids, dielectric fluids such as transformer fluids, greases, drilling fluids, crankcase oils, hydraulic fluids, passenger car motor oils (PCMO), two- and four-stroke lubricants, metalworking fluids, food-grade lubricants, refrigerating fluids, compressor fluids, and plasticized compositions.

The use of lubricants and lubricating fluid compositions may result in the dispersion of such fluids, compounds, and/or compositions in the environment. Petroleum base oils used in common lubricant compositions, as well as additives, are typically non-biodegradable and can be toxic. The present disclosure provides for the preparation and use of compositions comprising partially or fully biodegradable base oils, including base oils comprising one or more estolides.

In certain embodiments, the lubricants and/or compositions comprising one or more estolides are partially or fully biodegradable and thereby pose diminished risk to the environment. In certain embodiments, the lubricants and/or compositions meet guidelines set for by the Organization for Economic Cooperation and Development (OECD) for degradation and accumulation testing. The OECD has indicated that several tests may be used to determine the "ready biodegradability" of organic chemicals. Aerobic ready biodegradability by OECD 301D measures the mineralization of the test sample to $CO_2$ in closed aerobic microcosms that simulate an aerobic aquatic environment, with microorganisms seeded from a waste-water treatment plant. OECD 301D is considered representative of most aerobic environments that are likely to receive waste materials. Aerobic "ultimate biodegradability" can be determined by OECD 302D. Under OECD 302D, microorganisms are pre-acclimated to biodegradation of the test material during a pre-incubation period, then incubated in sealed vessels with relatively high concentrations of microorganisms and enriched mineral salts medium. OECD 302D ultimately determines whether the test materials are completely biodegradable, albeit under less stringent conditions than "ready biodegradability" assays.

As used in the present specification, the following words, phrases and symbols are generally intended to have the meanings as set forth below, except to the extent that the context in which they are used indicates otherwise. The following abbreviations and terms have the indicated meanings throughout:

A dash ("—") that is not between two letters or symbols is used to indicate a point of attachment for a substituent. For example, —C(O)$NH_2$ is attached through the carbon atom.

"Alkoxy" by itself or as part of another substituent refers to a radical —$OR^{31}$ where $R^{31}$ is alkyl, cycloalkyl, cycloalkylalkyl, aryl, or arylalkyl, which can be substituted, as defined herein. In some embodiments, alkoxy groups have from 1 to 8 carbon atoms. In some embodiments, alkoxy groups have 1, 2, 3, 4, 5, 6, 7, or 8 carbon atoms. Examples of alkoxy groups include, but are not limited to, methoxy, ethoxy, propoxy, butoxy, cyclohexyloxy, and the like.

"Alkyl" by itself or as part of another substituent refers to a saturated or unsaturated, branched, or straight-chain monovalent hydrocarbon radical derived by the removal of one hydrogen atom from a single carbon atom of a parent alkane, alkene, or alkyne. Examples of alkyl groups include, but are not limited to, methyl; ethyls such as ethanyl, ethenyl, and ethynyl; propyls such as propan-1-yl, propan-2-yl, prop-1-en-1-yl, prop-1-en-2-yl, prop-2-en-1-yl (allyl), prop-1-yn-1-yl, prop-2-yn-1-yl, etc.; butyls such as butan-1-yl, butan-2-yl, 2-methyl-propan-1-yl, 2-methyl-propan-2-yl, but-1-en-1-yl, but-1-en-2- yl, 2-methyl-prop-1-en-1-yl, but-2-en-1-yl, but-2-en-2-yl, buta-1,3-dien-1-yl, buta-1,3-dien-2-yl, but-1-yn-1-yl, but-1-yn-3-yl, but-3-yn-1-yl, etc.; and the like.

Unless otherwise indicated, the term "alkyl" is specifically intended to include groups having any degree or level of saturation, i.e., groups having exclusively single carbon-carbon bonds, groups having one or more double carbon-carbon bonds, groups having one or more triple carbon-carbon bonds, and groups having mixtures of single, double, and triple carbon-carbon bonds. Where a specific level of saturation is intended, the terms "alkanyl," "alkenyl," and "alkynyl" are used. In certain embodiments, an alkyl group comprises from 1 to 40 carbon atoms, in certain embodiments, from 1 to 22 or 1 to 18 carbon atoms, in certain embodiments, from 1 to 16 or 1 to 8 carbon atoms, and in certain embodiments from 1 to 6 or 1 to 3 carbon atoms. In certain embodiments, an alkyl group comprises from 8 to 22 carbon atoms, in certain embodiments, from 8 to 18 or 8 to 16. In some embodiments, the alkyl group comprises from 3 to 20 or 7 to 17 carbons. In some embodiments, the alkyl group comprises 1, 2, 3, 4, 5, 6, 7, 8, 9, 10, 11, 12, 13, 14, 15, 16, 17, 18, 19, 20, 21, or 22 carbon atoms.

"Aryl" by itself or as part of another substituent refers to a monovalent aromatic hydrocarbon radical derived by the removal of one hydrogen atom from a single carbon atom of a parent aromatic ring system. Aryl encompasses 5- and 6-membered carbocyclic aromatic rings, for example, benzene; bicyclic ring systems wherein at least one ring is carbocyclic and aromatic, for example, naphthalene, indane, and tetralin; and tricyclic ring systems wherein at least one ring is carbocyclic and aromatic, for example, fluorene. Aryl encompasses multiple ring systems having at least one carbocyclic aromatic ring fused to at least one carbocyclic aromatic ring, cycloalkyl ring, or heterocycloalkyl ring. For example, aryl includes 5- and 6-membered carbocyclic aromatic rings fused to a 5- to 7-membered non-aromatic heterocycloalkyl ring containing one or more heteroatoms chosen from N, O, and S. For such fused, bicyclic ring systems wherein only one of the rings is a carbocyclic aromatic ring, the point of attachment may be at the carbocyclic aromatic ring or the heterocycloalkyl ring. Examples of aryl groups include, but are not limited to, groups derived from aceanthrylene, acenaphthylene, acephenanthrylene, anthracene, azulene, benzene, chrysene, coronene, fluoranthene, fluorene, hexacene, hexaphene, hexylene, as-indacene, s-indacene, indane, indene, naphthalene, octacene, octaphene, octalene, ovalene, penta-2,4-diene, pentacene, pentalene, pentaphene, perylene, phenalene, phenanthrene, picene, pleiadene, pyrene, pyranthrene, rubicene, triphenylene, trinaphthalene, and the like. In certain embodiments, an aryl group can comprise from 5 to 20 carbon atoms, and in certain embodiments, from 5 to 12 carbon atoms. In certain embodiments, an aryl group can comprise 5, 6, 7, 8, 9, 10, 11, 12, 13, 14, 15, 16, 17, 18, 19, or 20 carbon atoms. Aryl, however, does not encompass or overlap in any way with heteroaryl, separately defined herein. Hence, a multiple ring system in which one or more carbocyclic aromatic rings is fused to a heterocycloalkyl aromatic ring, is heteroaryl, not aryl, as defined herein.

"Arylalkyl" by itself or as part of another substituent refers to an acyclic alkyl radical in which one of the hydrogen atoms bonded to a carbon atom, typically a terminal or $sp^3$ carbon atom, is replaced with an aryl group. Examples of arylalkyl groups include, but are not limited to, benzyl, 2-phenylethan-1-yl, 2-phenylethen-1-yl, naphthylmethyl, 2-naphthylethan-1-yl, 2-naphthylethen-1-yl, naphthobenzyl, 2-naphthophenylethan-1-yl, and the like. Where specific alkyl moieties are intended, the nomenclature arylalkanyl, arylalkenyl, or arylalkynyl is used. In certain embodiments, an arylalkyl group is $C_{7-30}$ arylalkyl, e.g., the alkanyl, alkenyl, or alkynyl moiety of the arylalkyl group is $C_{1-10}$ and the aryl moiety is $C_{6-20}$, and in certain embodiments, an arylalkyl group is $C_{7-20}$ arylalkyl, e.g., the alkanyl, alkenyl, or alkynyl moiety of the arylalkyl group is $C_{1-8}$ and the aryl moiety is $C_{6-12}$.

Estolide "base oil" and "base stock", unless otherwise indicated, refer to any composition comprising one or more estolide compounds. It should be understood that an estolide "base oil" or "base stock" is not limited to compositions for a particular use, and may generally refer to compositions comprising one or more estolides, including mixtures of estolides. Estolide base oils and base stocks can also include compounds other than estolides.

"Antioxidant" refers to a substance that is capable of inhibiting, preventing, reducing, or ameliorating oxidative reactions in another substance (e.g., base oil such as an estolide compound) when the antioxidant is used in a composition (e.g., lubricant formulation) that includes such other substances. An example of an "antioxidant" is an oxygen scavenger.

"Compounds" refers to compounds encompassed by structural Formula I and II herein and includes any specific compounds within the formula whose structure is disclosed herein. Compounds may be identified either by their chemical structure and/or chemical name. When the chemical structure and chemical name conflict, the chemical structure is determinative of the identity of the compound. The compounds described herein may contain one or more chiral centers and/or double bonds and therefore may exist as stereoisomers such as double-bond isomers (i.e., geometric isomers), enantiomers, or diastereomers. Accordingly, any chemical structures within the scope of the specification depicted, in whole or in part, with a relative configuration encompass all possible enantiomers and stereoisomers of the illustrated compounds including the stereoisomerically pure form (e.g., geometrically pure, enantiomerically pure, or diastereomerically pure) and enantiomeric and stereoisomeric mixtures. Enantiomeric and stereoisomeric mixtures may be resolved into their component enantiomers or stereoisomers using separation techniques or chiral synthesis techniques well known to the skilled artisan.

For the purposes of the present disclosure, "chiral compounds" are compounds having at least one center of chirality (i.e. at least one asymmetric atom, in particular at least one asymmetric C atom), having an axis of chirality, a plane of chirality or a screw structure. "Achiral compounds" are compounds which are not chiral.

Compounds of Formula I and II include, but are not limited to, optical isomers of compounds of Formula I and II, racemates thereof, and other mixtures thereof. In such embodiments, the single enantiomers or diastereomer I and II s, i.e., optically active forms, can be obtained by asymmetric synthesis or by resolution of the racemates. Resolution of the racemates may be accomplished by, for example, chromatography, using, for example a chiral high-pressure liquid chromatography (HPLC) column. However, unless otherwise stated, it should be assumed that Formula I and II cover all asymmetric variants of the compounds described herein, including isomers, racemates, enantiomers, diastereomers, and other mixtures thereof. In addition, compounds of Formula I and II include Z- and E-forms (e.g., cis- and trans-forms) of compounds with double bonds. The compounds of Formula I and II may also exist in several tautomeric forms including the enol form, the keto form, and mixtures thereof. Accordingly, the chemical structures depicted herein encompass all possible tautomeric forms of the illustrated compounds.

"Cycloalkyl" by itself or as part of another substituent refers to a saturated or unsaturated cyclic alkyl radical. Where a specific level of saturation is intended, the nomenclature "cycloalkanyl" or "cycloalkenyl" is used. Examples of cycloalkyl groups include, but are not limited to, groups derived from cyclopropane, cyclobutane, cyclopentane, cyclohexane, and the like. In certain embodiments, a cycloalkyl group is $C_{3-15}$ cycloalkyl, and in certain embodiments, $C_{3-12}$ cycloalkyl or $C_{5-12}$ cycloalkyl. In certain embodiments, a cycloalkyl group is a $C_5$, $C_6$, $C_7$, $C_8$, $C_9$, $C_{10}$, $C_{11}$, $C_{12}$, $C_{13}$, $C_{14}$, or $C_{15}$ cycloalkyl.

"Cycloalkylalkyl" by itself or as part of another substituent refers to an acyclic alkyl radical in which one of the hydrogen atoms bonded to a carbon atom, typically a terminal or $sp^3$ carbon atom, is replaced with a cycloalkyl group. Where specific alkyl moieties are intended, the nomenclature cycloalkylalkanyl, cycloalkylalkenyl, or cycloalkylalkynyl is used. In certain embodiments, a cycloalkylalkyl group is $C_{7-30}$ cycloalkylalkyl, e.g., the alkanyl, alkenyl, or alkynyl moiety of the cycloalkylalkyl group is $C_{1-10}$ and the cycloalkyl moiety is $C_{6-20}$, and in certain embodiments, a cycloalkylalkyl group is $C_{7-20}$ cycloalkylalkyl, e.g., the alkanyl, alkenyl, or alkynyl moiety of the cycloalkylalkyl group is $C_{1-8}$ and the cycloalkyl moiety is $C_{4-20}$ or $C_{6-12}$.

"Halogen" refers to a fluoro, chloro, bromo, or iodo group.

"Heteroaryl" by itself or as part of another substituent refers to a monovalent heteroaromatic radical derived by the removal of one hydrogen atom from a single atom of a parent heteroaromatic ring system. Heteroaryl encompasses multiple ring systems having at least one aromatic ring fused to at least one other ring, which can be aromatic or non-aromatic in which at least one ring atom is a heteroatom. Heteroaryl encompasses 5- to 12-membered aromatic, such as 5- to 7-membered, monocyclic rings containing one or more, for example, from 1 to 4, or in certain embodiments, from 1 to 3, heteroatoms chosen from N, O, and S, with the remaining ring atoms being carbon; and bicyclic heterocycloalkyl rings containing one or more, for example, from 1 to 4, or in certain embodiments, from 1 to 3, heteroatoms chosen from N, O, and S, with the remaining ring atoms being carbon and wherein at least one heteroatom is present in an aromatic ring. For example, heteroaryl includes a 5- to 7-membered heterocycloalkyl, aromatic ring fused to a 5- to 7-membered cycloalkyl ring. For such fused, bicyclic heteroaryl ring systems wherein only one of the rings contains one or more heteroatoms, the point of attachment may be at the heteroaromatic ring or the cycloalkyl ring. In certain embodiments, when the total number of N, S, and O atoms in the heteroaryl group exceeds one, the heteroatoms are not adjacent to one another. In certain embodiments, the total number of N, S, and O atoms in the heteroaryl group is not more than two. In certain embodiments, the total number of N, S, and O atoms in the aromatic heterocycle is not more than one. Heteroaryl does not encompass or overlap with aryl as defined herein.

Examples of heteroaryl groups include, but are not limited to, groups derived from acridine, arsindole, carbazole, β-carboline, chromane, chromene, cinnoline, furan, imidazole, indazole, indole, indoline, indolizine, isobenzofuran, isochromene, isoindole, isoindoline, isoquinoline, isothiazole, isoxazole, naphthyridine, oxadiazole, oxazole, perimidine, phenanthridine, phenanthroline, phenazine, phthalazine, pteridine, purine, pyran, pyrazine, pyrazole, pyridazine, pyridine, pyrimidine, pyrrole, pyrrolizine, quinazoline, quinoline, quinolizine, quinoxaline, tetrazole, thiadiazole, thiazole, thiophene, triazole, xanthene, and the like. In certain embodiments, a heteroaryl group is from 5- to 20-membered heteroaryl, and in certain embodiments from 5- to 12-membered heteroaryl or from 5- to 10-membered heteroaryl. In certain embodiments, a heteroaryl group is a 5-, 6-, 7-, 8-, 9-, 10-, 11-, 12-, 13-, 14-, 15-, 16-, 17-, 18-, 19-, or 20-membered heteroaryl. In certain embodiments heteroaryl groups are those derived from thiophene, pyrrole, benzothiophene, benzofuran, indole, pyridine, quinoline, imidazole, oxazole, and pyrazine.

"Heteroarylalkyl" by itself or as part of another substituent refers to an acyclic alkyl radical in which one of the hydrogen atoms bonded to a carbon atom, typically a terminal or $sp^3$ carbon atom, is replaced with a heteroaryl group. Where specific alkyl moieties are intended, the nomenclature heteroarylalkanyl, heteroarylalkenyl, or heteroarylalkynyl is used. In certain embodiments, a heteroarylalkyl group is a 6- to 30-membered heteroarylalkyl, e.g., the alkanyl, alkenyl, or alkynyl moiety of the heteroarylalkyl is 1- to 10-membered and the heteroaryl moiety is a 5- to 20-membered heteroaryl, and in certain embodiments, 6- to 20-membered heteroarylalkyl, e.g., the alkanyl, alkenyl, or alkynyl moiety of the heteroarylalkyl is 1- to 8-membered and the heteroaryl moiety is a 5- to 12-membered heteroaryl.

"Heterocycloalkyl" by itself or as part of another substituent refers to a partially saturated or unsaturated cyclic alkyl radical in which one or more carbon atoms (and any associated hydrogen atoms) are independently replaced with the same or different heteroatom. Examples of heteroatoms to replace the carbon atom(s) include, but are not limited to, N, P, O, S, Si, etc. Where a specific level of saturation is intended, the nomenclature "heterocycloalkanyl" or "heterocycloalkenyl" is used. Examples of heterocycloalkyl groups include, but are not limited to, groups derived from epoxides, azirines, thiiranes, imidazolidine, morpholine, piperazine, piperidine, pyrazolidine, pyrrolidine, quinuclidine, and the like.

"Heterocycloalkylalkyl" by itself or as part of another substituent refers to an acyclic alkyl radical in which one of the hydrogen atoms bonded to a carbon atom, typically a terminal or $sp^3$ carbon atom, is replaced with a heterocycloalkyl group. Where specific alkyl moieties are intended, the nomenclature heterocycloalkylalkanyl, heterocycloalkylalkenyl, or heterocycloalkylalkynyl is used. In certain embodiments, a heterocycloalkylalkyl group is a 6- to 30-membered heterocycloalkylalkyl, e.g., the alkanyl, alkenyl, or alkynyl moiety of the heterocycloalkylalkyl is 1- to 10-membered and the heterocycloalkyl moiety is a 5- to 20-membered heterocycloalkyl, and in certain embodiments, 6- to 20-membered heterocycloalkylalkyl, e.g., the alkanyl, alkenyl, or alkynyl moiety of the heterocycloalkylalkyl is 1- to 8-membered and the heterocycloalkyl moiety is a 5- to 12-membered heterocycloalkyl.

"Mixture" refers to a collection of molecules or chemical substances. Each component in a mixture can be independently varied. A mixture may contain, or consist essentially of, two or more substances intermingled with or without a constant percentage composition, wherein each component may or may not retain its essential original properties, and where molecular phase mixing may or may not occur. In mixtures, the components making up the mixture may or may not remain distinguishable from each other by virtue of their chemical structure.

"Parent aromatic ring system" refers to an unsaturated cyclic or polycyclic ring system having a conjugated π (pi) electron system. Included within the definition of "parent aromatic ring system" are fused ring systems in which one or more of the rings are aromatic and one or more of the rings are saturated or unsaturated, such as, for example, fluorene, indane, indene, phenalene, etc. Examples of parent aromatic ring systems include, but are not limited to, aceanthrylene, acenaphthylene, acephenanthrylene, anthracene, azulene, benzene, chrysene, coronene, fluoranthene, fluorene, hexacene, hexaphene, hexylene, as-indacene, s-indacene, indane, indene, naphthalene, octacene, octaphene, octalene, ovalene, penta-2,4-diene, pentacene, pentalene, pentaphene, perylene, phenalene, phenanthrene, picene, pleiadene, pyrene, pyranthrene, rubicene, triphenylene, trinaphthalene, and the like.

"Parent heteroaromatic ring system" refers to a parent aromatic ring system in which one or more carbon atoms (and any associated hydrogen atoms) are independently replaced with the same or different heteroatom. Examples of heteroatoms to replace the carbon atoms include, but are not limited to, N, P, O, S, Si, etc. Specifically included within the definition of "parent heteroaromatic ring systems" are fused ring systems in which one or more of the rings are aromatic and one or more of the rings are saturated or unsaturated, such as, for example, arsindole, benzodioxan, benzofuran, chromane, chromene, indole, indoline, xanthene, etc. Examples of parent heteroaromatic ring systems include, but are not limited to, arsindole, carbazole, β-carboline, chromane, chromene, cinnoline, furan, imidazole, indazole, indole, indoline, indolizine, isobenzofuran, isochromene, isoindole, isoindoline, isoquinoline, isothiazole, isoxazole, naphthyridine, oxadiazole, oxazole, perimidine, phenanthridine, phenanthroline, phenazine, phthalazine, pteridine, purine, pyran, pyrazine, pyrazole, pyridazine, pyridine, pyrimidine, pyrrole, pyrrolizine, quinazoline, quinoline, quinolizine, quinoxaline, tetrazole, thiadiazole, thiazole, thiophene, triazole, xanthene, and the like.

"Substituted" refers to a group in which one or more hydrogen atoms are independently replaced with the same or different substituent(s). Examples of substituents include, but are not limited to, $—R^{64}$, $—R^{60}$, $—O^-$, —OH, =O, $—OR^{60}$, $—SR^{60}$, $—S^-$, =S, $—NR^{60}R^{61}$, $=NR^{60}$, —CN, $—CF_3$, —OCN, —SCN, —NO, $—NO_2$, $=N_2$, $—N_3$, $—S(O)_2O^-$, $—S(O)_2OH$, $—S(O)_2R^{60}$, $—OS(O_2)O^-$, $—OS(O)_2R^{60}$, $—P(O)(O^-)_2$, $—P(O)(OR^{60})(O^-)$, $—OP(O)(OR^{60})(OR^{61})$, $—C(O)R^{60}$, $—C(S)R^{60}$, $—C(O)OR^{60}$, $—C(O)NR^{60}R^{61}$, $—C(O)O^-$, $—C(S)OR^{60}$, $—NR^{62}C(O)NR^{60}R^{61}$, $—NR^{62}C(S)NR^{60}R^{61}$, $—NR^{62}C(NR^{63})NR^{60}R^{61}$, $—C(NR^{62})NR^{60}R^{61}$, $—S(O)_2$, $NR^{60}R^{61}$, $—NR^{63}S(O)_2R^{60}$, $—NR^{63}C(O)R^{60}$, and $—S(O)R^{60}$;

wherein each $—R^{64}$ is independently a halogen; each $R^{60}$ and $R^{61}$ are independently alkyl, substituted alkyl, alkoxy, substituted alkoxy, cycloalkyl, substituted cycloalkyl, heterocycloalkyl, substituted heterocycloalkyl, aryl, substituted aryl, heteroaryl, substituted heteroaryl, arylalkyl, substituted arylalkyl, heteroarylalkyl, or substituted heteroarylalkyl, or $R^{60}$ and $R^{61}$ together with the nitrogen atom to which they are bonded form a heterocycloalkyl, substituted heterocycloalkyl, heteroaryl, or substituted heteroaryl ring, and $R^{62}$ and $R^{63}$ are independently alkyl, substituted alkyl, aryl, substituted aryl, arylalkyl, substituted arylalkyl, cycloalkyl, substituted cycloalkyl, heterocycloalkyl, substituted heterocycloalkyl, heteroaryl, substituted heteroaryl, heteroarylalkyl, or substituted heteroarylalkyl, or $R^{62}$ and $R^{63}$ together with the atom to which they are bonded form one or more heterocycloalkyl, substituted heterocycloalkyl, heteroaryl, or substituted heteroaryl rings;

wherein the "substituted" substituents, as defined above for $R^{60}$, $R^{61}$, $R^{62}$, and $R^{63}$, are substituted with one or more, such as one, two, or three, groups independently selected from alkyl, -alkylOH, O-haloalkyl, alkyl$NH_2$, alkoxy, cycloalkyl, cycloalkylalkyl, heterocycloalkyl, heterocycloalkylalkyl, aryl, heteroaryl, arylalkyl, heteroarylalkyl, $—O^-$, —OH, =O, —O-alkyl, —O-aryl, —O-heteroarylalkyl, —O-cycloalkyl, —O-heterocycloalkyl, —SH, $—S^-$, =S, —S-alkyl, —S-aryl, —S-heteroarylalkyl, —S-cycloalkyl, —S-heterocycloalkyl, $—NH_2$, =NH, —CN, $—CF_3$, —OCN, —SCN, —NO, $—NO_2$, $=N_2$, $—N_3$, $—S(O)_2O$, $—S(O)_2$, $—S(O)_2OH$, $—OS(O_2)O^-$, $—SO_2$(alkyl), $—SO_2$(phenyl), $—SO_2$(haloalkyl), $—SO_2NH_2$, $SO_2NH$(alkyl), $SO_2NH$(phenyl), $—P(O)(O^-)_2$, —P(O)(O-alkyl)($O^-$), —OP(O)(O-alkyl)(O-alkyl), $CO_2H$, C(O)O(alkyl), CON(alkyl)(alkyl), —CONH(alkyl), $CONH_2$, C(O)(alkyl), C(O)(phenyl), C(O)(haloalkyl), OC(O)(alkyl), N(alkyl)(alkyl), NH(alkyl), N(alkyl)(alkylphenyl), NH(alkylphenyl), NHC(O)(alkyl), NHC(O)(phenyl), —N(alkyl)C(O)(alkyl), and N(alkyl)C(O)(phenyl).

As used in this specification and the appended claims, the articles "a," "an," and "the" include plural referents unless expressly and unequivocally limited to one referent.

All numerical ranges herein include all numerical values and ranges of all numerical values within the recited range of numerical values.

The present disclosure relates compositions comprising one or more estolide compounds, and methods of making the same. In certain embodiments, the composition comprises a composition suitable for use as an engine lubricant. In certain embodiments, the composition comprises an estolide base oil and an additive package. In certain embodiments, the composition comprises:

an additive package; and at least one estolide compound selected from compounds of Formula I:

Formula I

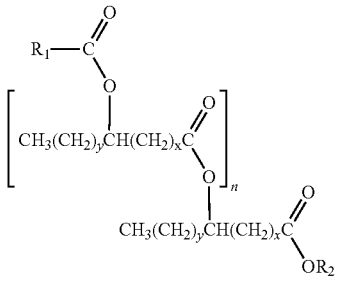

wherein x is, independently for each occurrence, an integer selected from 0 to 20;

y is, independently for each occurrence, an integer selected from 0 to 20;

n is an integer equal to or greater than 0;

$R_1$ is an optionally substituted alkyl that is saturated or unsaturated, and branched or unbranched; and $R_2$ is selected from hydrogen and optionally substituted alkyl that is saturated or unsaturated, and branched or unbranched;

wherein each fatty acid chain residue of said at least one estolide compound is independently optionally substituted.

In certain embodiments, the composition comprises:

an additive package; and at least one estolide compound selected from compounds of Formula II:

Formula II

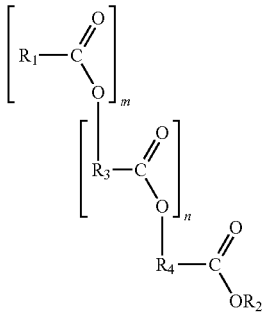

wherein m is an integer equal to or greater than 1;

n is an integer equal to or greater than 0;

$R_1$, independently for each occurrence, is an optionally substituted alkyl that is saturated or unsaturated, and branched or unbranched;

$R_2$ is selected from hydrogen and optionally substituted alkyl that is saturated or unsaturated, and branched or unbranched; and $R_3$ and $R_4$, independently for each occurrence, are selected from optionally substituted alkyl that is saturated or unsaturated, and branched or unbranched.

In certain embodiments, the composition comprises at least one estolide compound of Formula I or II, wherein $R_1$ is hydrogen.

The terms "chain" or "fatty acid chain" or "fatty acid chain residue," as used with respect to the estolide compounds of Formula I and II, refer to one or more of the fatty acid residues incorporated in estolide compounds, e.g., $R_3$ or $R_4$ of Formula II, or the structures represented by $CH_3(CH_2)_yCH(CH_2)_xC(O)O$— in Formula I.

The $R_1$ in Formula I and II at the top of each Formula shown is an example of what may be referred to as a "cap" or "capping material," as it "caps" the top of the estolide. Similarly, the capping group may be an organic acid residue of general formula —OC(O)-alkyl, i.e., a carboxylic acid with a substituted or unsubstituted, saturated or unsaturated, and/or branched or unbranched alkyl as defined herein, or a formic acid residue. In certain embodiments, the "cap" or "capping group" is a fatty acid. In certain embodiments, the capping group, regardless of size, is substituted or unsubstituted, saturated or unsaturated, and/or branched or unbranched. The cap or capping material may also be referred to as the primary or alpha (α) chain.

Depending on the manner in which the estolide is synthesized, the cap or capping group alkyl may be the only alkyl from an organic acid residue in the resulting estolide that is unsaturated. In certain embodiments, it may be desirable to use a saturated organic or fatty-acid cap to increase the overall saturation of the estolide and/or to increase the resulting estolide's stability. For example, in certain embodiments, it may be desirable to provide a method of providing a saturated capped estolide by hydrogenating an unsaturated cap using any suitable methods available to those of ordinary skill in the art. Hydrogenation may be used with various sources of the fatty-acid feedstock, which may include mono- and/or polyunsaturated fatty acids. Without being bound to any particular theory, in certain embodiments, hydrogenating the estolide may help to improve the overall stability of the molecule. However, a fully-hydrogenated estolide, such as an estolide with a larger fatty acid cap, may exhibit increased pour point temperatures. In certain embodiments, it may be desirable to offset any loss in desirable pour-point characteristics by using shorter, saturated capping materials.

The $R_4C(O)O$— of Formula II or structure $CH_3(CH_2)_yCH(CH_2)_xC(O)O$— of Formula I serve as the "base" or "base chain residue" of the estolide. Depending on the manner in which the estolide is synthesized, the base organic acid or fatty acid residue may be the only residue that remains in its free-acid form after the initial synthesis of the estolide. However, in certain embodiments, in an effort to alter or improve the properties of the estolide, the free acid may be reacted with any number of substituents. For example, it may be desirable to react the free acid estolide with alcohols, glycols, amines, or other suitable reactants to provide the corresponding ester, amide, or other reaction products. The base or base chain residue may also be referred to as tertiary or gamma (γ) chains.

The $R_3C(O)O$— of Formula II or structure $CH_3(CH_2)_yCH(CH_2)_xC(O)O$— of Formula I are linking residues that link the capping material and the base fatty-acid residue together. There may be any number of linking residues in the estolide, including when n=0 and the estolide is in its dimer form. Depending on the manner in which the estolide is prepared, a linking residue may be a fatty acid and may initially be in an unsaturated form during synthesis. In some embodiments, the estolide will be formed when a catalyst is used to produce a carbocation at the fatty acid's site of unsaturation, which is followed by nucleophilic attack on the carbocation by the carboxylic group of another fatty acid. In some embodiments, it may be desirable to have a linking fatty acid that is monounsaturated so that when the fatty acids link together, all of the sites of unsaturation are eliminated. The linking residue(s) may also be referred to as secondary or beta (β) chains.

In certain embodiments, the cap is an acetyl group, the linking residue(s) is one or more fatty acid residues, and the base chain residue is a fatty acid residue. In certain embodiments, the linking residues present in an estolide differ from one another. In certain embodiments, one or more of the linking residues differs from the base chain residue.

As noted above, in certain embodiments, suitable unsaturated fatty acids for preparing the estolides may include any mono- or polyunsaturated fatty acid. For example, monounsaturated fatty acids, along with a suitable catalyst, will form a single carbocation that allows for the addition of a second fatty acid, whereby a single link between two fatty acids is formed. Suitable monounsaturated fatty acids may include, but are not limited to, palmitoleic acid (16:1), vaccenic acid (18:1), oleic acid (18:1), eicosenoic acid (20:1), erucic acid (22:1), and nervonic acid (24:1). In addition, in certain embodiments, polyunsaturated fatty acids may be used to create estolides. Suitable polyunsaturated fatty acids may include, but are not limited to, hexadecatrienoic acid (16:3), alpha-linolenic acid (18:3), stearidonic acid (18:4), eicosatrienoic acid (20:3), eicosatetraenoic acid (20:4), eicosapentaenoic acid (20:5), heneicosapentaenoic acid (21:5), docosapentaenoic acid (22:5), docosahexaenoic acid (22:6), tetracosapentaenoic acid (24:5), tetracosahexaenoic acid (24:6), linoleic acid (18:2), gamma-linoleic acid (18:3), eicosadienoic acid (20:2), dihomo-gamma-linolenic acid (20:3), arachidonic acid (20:4), docosadienoic acid (20:2), adrenic acid (22:4), docosapentaenoic acid (22:5), tetracosatetraenoic acid (22:4), tetracosapentaenoic acid (24:5), pinolenic acid (18:3), podocarpic acid (20:3), rumenic acid (18:2), alpha-calendic acid (18:3), beta-calendic acid (18:3), jacaric acid (18:3), alpha-eleostearic acid (18:3), beta-eleostearic (18:3), catalpic acid (18:3), punicic acid (18:3), rumelenic acid (18:3), alpha-parinaric acid (18:4), beta-parinaric acid (18:4), and bosseopentaenoic acid (20:5). Other exemplay fatty acids may include terminally-unsaturated fatty acids such as 10-undecenoic acid, which may be derived from castor oil. In certain embodiments, hydroxy fatty acids may be polymerized or homopolymerized by reacting the carboxylic acid functionality of one fatty acid with the hydroxy functionality of a second fatty acid. Exemplary hydroxyl fatty acids include, but are not limited to, ricinoleic acid, 6-hydroxystearic acid, 9,10-dihydroxystearic acid, 12-hydroxystearic acid, and 14-hydroxystearic acid.

The process for preparing the estolide compounds described herein may include the use of any natural or synthetic fatty acid source. However, it may be desirable to source the fatty acids from a renewable biological feedstock. For example, suitable starting materials of biological origin include, but are not limited to, plant fats, plant oils, plant waxes, animal fats, animal oils, animal waxes, fish fats, fish oils, fish waxes, algal oils and mixtures of two or more thereof. Other potential fatty acid sources include, but are not limited to, waste and recycled food-grade fats and oils, fats, oils, and waxes obtained by genetic engineering, fossil fuel-based materials and other sources of the materials desired.

In certain embodiments, the estolide compounds described herein may be prepared from non-naturally occurring fatty acids derived from naturally occurring feedstocks. In certain embodiments, the estolides are prepared from synthetic fatty acid reactants derived from naturally occurring feedstocks such as vegetable oils. For example, the synthetic fatty acid reactants may be prepared by cleaving fragments from larger fatty acid residues occurring in natural oils such as triglycerides using, for example, a cross-metathesis catalyst and alpha-olefin(s). The resulting truncated fatty acid residue(s) may be liberated from the glycerine backbone using any suitable hydrolytic and/or transesterification processes known to those of skill in the art. An exemplary fatty acid reactants include 9-dodecenoic acid and 9-decenoic acid, which may be prepared via the cross metathesis of an oleic acid residue with 1-butene.

In some embodiments, the compound comprises chain residues of varying lengths. In some embodiments, x is, independently for each occurrence, an integer selected from 0 to 20, 0 to 18, 0 to 16, 0 to 14, 1 to 12, 1 to 10, 2 to 8, 6 to 8, or 4 to 6. In some embodiments, x is, independently for each occurrence, an integer selected from 7 and 8. In some embodiments, x is, independently for each occurrence, an integer selected from 0, 1, 2, 3, 4, 5, 6, 7, 8, 9, 10, 11, 12, 13, 14, 15, 16, 17, 18, 19, and 20. In certain embodiments, for at least one chain residue, x is an integer selected from 7 and 8.

In some embodiments, y is, independently for each occurrence, an integer selected from 0 to 20, 0 to 18, 0 to 16, 0 to 14, 1 to 12, 1 to 10, 2 to 8, 6 to 8, or 4 to 6. In some embodiments, y is, independently for each occurrence, an integer selected from 7 and 8. In some embodiments, y is, independently for each occurrence, an integer selected from 0, 1, 2, 3, 4, 5, 6, 7, 8, 9, 10, 11, 12, 13, 14, 15, 16, 17, 18, 19, and 20. In certain embodiments, for at least one chain residue, y is an integer selected from 7 and 8. In some embodiments, for at least one chain residue, y is an integer selected from 0 to 6, or 1 and 2. In certain embodiments, y is, independently for each occurrence, an integer selected from 1 to 6, or 1 and 2. In certain embodiments, y is 0.

In some embodiments, x+y is, independently for each chain, an integer selected from 0 to 40, 0 to 20, 10 to 20, or 12 to 18. In some embodiments, x+y is, independently for each chain, an integer selected from 13 to 15. In some embodiments, x+y is 15. In some embodiments, x+y is, independently for each chain, an integer selected from 6, 7, 8, 9, 10, 11, 12, 13, 14, 15, 16, 17, 18, 19, 20, 21, 22, 23, and 24.

In some embodiments, the estolide compound of Formula I or II may comprise any number of fatty acid residues to form an "n-mer" estolide. For example, the estolide may be in its dimer (n=0), trimer (n=1), tetramer (n=2), pentamer (n=3), hexamer (n=4), heptamer (n=5), octamer (n=6), nonamer (n=7), or decamer (n=8) form. In some embodiments, n is an integer selected from 0 to 20, 0 to 18, 0 to 16, 0 to 14, 0 to 12, 0 to 10, 0 to 8, or 0 to 6. In some embodiments, n is an integer selected from 0 to 4. In some embodiments, n is 0 or greater than 0. In some embodiments, n is 1, wherein said at least one compound of Formula I or II comprises the trimer. In some embodiments, n is greater than 1. In some embodiments, n is an integer selected from 0, 1, 2, 3, 4, 5, 6, 7, 8, 9, 10, 11, 12, 13, 14, 15, 16, 17, 18, 19, and 20.

In some embodiments, $R_1$ of Formula I or II is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, $R_1$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_1$ is selected from $C_{13}$ to $C_{17}$ alkyl, such as from $C_{13}$ alkyl, $C_{15}$ alkyl, and $C_{17}$ alkyl. In some embodiments, $R_1$ is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$s, $C_{16}$, $C_{17}$, $C_{18}$, $C_{19}$, $C_{20}$, $C_{21}$, or $C_{22}$ alkyl. In certain embodiments, $R_1$ is saturated. In certain embodiments, $R_1$ is unbranched.

In some embodiments, $R_2$ of Formula I or II is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, the alkyl group is selected from $C_6$ to $C_{12}$ alkyl. In some embodiments, $R_2$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_2$ is selected from $C_{13}$ to $C_{17}$ alkyl, such as from $C_{13}$ alkyl, $C_{15}$ alkyl, and $C_{17}$ alkyl. In some embodiments, $R_2$ is a $C_1$, $C_2$, $C_3$, $C_4$, $C_s$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ alkyl. In certain embodiments, $R_2$ is saturated. In certain embodiments, $R_2$ is branched.

In some embodiments, $R_3$ is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, $R_3$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_3$ is selected from $C_{13}$ to $C_{17}$ alkyl, such as from $C_{13}$ alkyl, $C_{15}$ alkyl, and $C_{17}$ alkyl. In some embodiments, $R_3$ is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ alkyl.

In some embodiments, $R_4$ is an optionally substituted alkyl that is saturated or unsaturated, and branched or unbranched. In some embodiments, the alkyl group is a $C_1$ to $C_{40}$ alkyl, $C_1$ to $C_{22}$ alkyl or $C_1$ to $C_{18}$ alkyl. In some embodiments, the alkyl group is selected from $C_7$ to $C_{17}$ alkyl. In some embodiments, $R_4$ is selected from $C_7$ alkyl, $C_9$ alkyl, $C_{11}$ alkyl, $C_{13}$ alkyl, $C_{15}$ alkyl, and $C_{17}$ alkyl. In some embodiments, $R_4$ is selected from $C_{13}$ to $C_{17}$ alkyl, such as from $C_{13}$ alkyl, $C_{15}$ alkyl, and $C_{17}$ alkyl. In some embodiments, $R_4$ is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ alkyl.

As noted above, in certain embodiments, it may be possible to manipulate one or more of the estolides' properties by altering the length of $R_1$ and/or its degree of saturation. However, in certain embodiments, the level of substitution on $R_1$ may also be altered to change or even improve the estolides' properties. Without being bound to any particular theory, in certain embodiments, it is believed that the presence of polar substituents on $R_1$, such as one or more hydroxy groups, may increase the viscosity of the estolide, while increasing pour point. Accordingly, in some embodiments, $R_1$ will be unsubstituted or optionally substituted with a group that is not hydroxyl.

In some embodiments, the estolide is in its free-acid form, wherein $R_2$ of Formula I or II is hydrogen. In some embodiments, $R_2$ is selected from optionally substituted alkyl that is saturated or unsaturated, and branched or unbranched. In certain embodiments, the $R_2$ residue may comprise any desired alkyl group, such as those derived from esterification of the estolide with the alcohols identified in the examples herein. In some embodiments, the alkyl group is selected from $C_1$ to $C_{40}$, $C_1$ to $C_{22}$, $C_3$ to $C_{20}$, $C_1$ to $C_{18}$, or $C_6$ to $C_{12}$ alkyl. In some embodiments, $R_2$ may be selected from $C_3$ alkyl, $C_4$ alkyl, $C_8$ alkyl, $C_{12}$ alkyl, $C_{16}$ alkyl, $C_{18}$ alkyl, and $C_{20}$ alkyl. For example, in certain embodiments, $R_2$ may be branched, such as isopropyl, isobutyl, or 2-ethylhexyl. In some embodiments, $R_2$ may be a larger alkyl group, branched or unbranched, comprising $C_{12}$ alkyl, $C_{16}$ alkyl, $C_{18}$ alkyl, or $C_{20}$ alkyl. Such groups at the $R_2$ position may be derived from esterification of the free-acid estolide using the Jarcol™ line of alcohols marketed by Jarchem Industries, Inc. of Newark, N.J., including Jarcol™ I-18CG, I-20, I-12, I-16, I-18T, and 85BJ. In some cases, $R_2$ may be sourced from certain alcohols to provide branched alkyls such as isostearyl and isopalmityl. It should be understood that such isopalmityl and isostearyl alkyl groups may cover any branched variation of $C_{16}$ and $C_{18}$, respectively. For example, the estolides described herein may comprise highly-branched isopalmityl or isostearyl groups at the $R_2$ position, derived from the Fineoxocol® line of isopalmityl and isostearyl alcohols marketed by Nissan Chemical America Corporation of Houston, Tex., including Fineoxocol® 180, 180N, and 1600. Without being bound to any particular theory, in certain embodiments, large, highly-branched alkyl groups (e.g., isopalmityl and isostearyl) at the $R_2$ position of the estolides can provide at least one way to increase an estolide-containing composition's viscosity, while substantially retaining or even reducing its pour point.

In some embodiments, the compounds described herein may comprise a mixture of two or more estolide compounds of Formula I or II. It is possible to characterize the chemical makeup of an estolide, a mixture of estolides, or a composition comprising estolides, by using the compound's, mixture's, or composition's measured estolide number (EN) of compound or composition. The EN represents the average number of fatty acids added to the base fatty acid. The EN also represents the average number of estolide linkages per molecule:

$$EN=n+1$$

wherein n is the number of secondary (β) fatty acids. Accordingly, a single estolide compound will have an EN that is a whole number, for example for dimers, trimers, and tetramers:

dimer EN=1
trimer EN=2
tetramer EN=3

However, a composition comprising two or more estolide compounds may have an EN that is a whole number or a fraction of a whole number. For example, a composition having a 1:1 molar ratio of dimer and trimer would have an EN of 1.5, while a composition having a 1:1 molar ratio of tetramer and trimer would have an EN of 2.5.

In some embodiments, the compositions may comprise a mixture of two or more estolides having an EN that is an integer or fraction of an integer that is greater than 4.5, or even 5.0. In some embodiments, the EN may be an integer or fraction of an integer selected from about 1.0 to about 5.0. In some embodiments, the EN is an integer or fraction of an integer selected from 1.2 to about 4.5. In some embodiments, the EN is selected from a value greater than 1.0, 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6 and 5.8. In some embodiments, the EN is selected from a value less than 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, and 5.0, 5.2, 5.4, 5.6, 5.8, and 6.0. In some embodiments, the EN is selected from 1, 1.2, 1.4, 1.6, 1.8, 2.0, 2.2, 2.4, 2.6, 2.8, 3.0, 3.2, 3.4, 3.6, 3.8, 4.0, 4.2, 4.4, 4.6, 4.8, 5.0, 5.2, 5.4, 5.6, 5.8, and 6.0.

As noted above, it should be understood that the chains of the estolide compounds may be independently optionally substituted, wherein one or more hydrogens are removed and replaced with one or more of the substituents identified herein. Similarly, two or more of the hydrogen residues may be removed to provide one or more sites of unsaturation, such as a cis or trans double bond. Further, the chains may optionally comprise branched hydrocarbon residues. For example, in some embodiments the estolides described herein may comprise at least one compound of Formula II:

Formula II

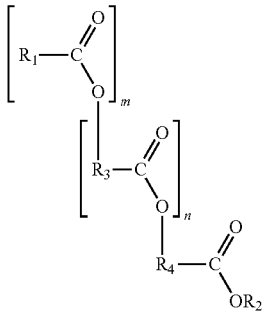

wherein m is an integer equal to or greater than 1;

n is an integer equal to or greater than 0;

$R_1$, independently for each occurrence, is an optionally substituted alkyl that is saturated or unsaturated, and branched or unbranched;

$R_2$ is selected from hydrogen and optionally substituted alkyl that is saturated or unsaturated, and branched or unbranched; and $R_3$ and $R_4$, independently for each occurrence, are selected from optionally substituted alkyl that is saturated or unsaturated, and branched or unbranched.

In certain embodiments, m is 1. In some embodiments, m is an integer selected from 2, 3, 4, and 5. In some embodiments, n is an integer selected from 1, 2, 3, 4, 5, 6, 7, 8, 9, 10, 11, and 12. In some embodiments, one or more $R_3$ differs from one or more other $R_3$ in a compound of Formula II. In some embodiments, one or more $R_3$ differs from $R_4$ in a compound of Formula II. In some embodiments, if the compounds of Formula II are prepared from one or more polyunsaturated fatty acids, it is possible that one or more of $R_3$ and $R_4$ will have one or more sites of unsaturation. In some embodiments, if the compounds of Formula II are prepared from one or more branched fatty acids, it is possible that one or more of $R_3$ and $R_4$ will be branched.

In some embodiments, $R_3$ and $R_4$ can be $CH_3(CH_2)_yCH(CH_2)_x$—, where x is, independently for each occurrence, an integer selected from 0, 1, 2, 3, 4, 5, 6, 7, 8, 9, 10, 11, 12, 13, 14, 15, 16, 17, 18, 19, and 20, and y is, independently for each occurrence, an integer selected from 0, 1, 2, 3, 4, 5, 6, 7, 8, 9, 10, 11, 12, 13, 14, 15, 16, 17, 18, 19, and 20. Where both $R_3$ and $R_4$ are $CH_3(CH_2)_yCH(CH_2)_x$—, the compounds may be compounds according to Formula I and III.

Without being bound to any particular theory, in certain embodiments, altering the EN produces estolide-containing compositions having desired viscometric properties while substantially retaining or even reducing pour point. For example, in some embodiments the estolides exhibit a decreased pour point upon increasing the EN value. Accordingly, in certain embodiments, a method is provided for retaining or decreasing the pour point of an estolide base oil by increasing the EN of the base oil, or a method is provided for retaining or decreasing the pour point of a composition comprising an estolide base oil by increasing the EN of the base oil. In some embodiments, the method comprises: selecting an estolide base oil having an initial EN and an initial pour point; and removing at least a portion of the base oil, said portion exhibiting an EN that is less than the initial EN of the base oil, wherein the resulting estolide base oil exhibits an EN that is greater than the initial EN of the base oil, and a pour point that is equal to or lower than the initial pour point of the base oil. In some embodiments, the selected estolide base oil is prepared by oligomerizing at least one first unsaturated fatty acid with at least one second unsaturated fatty acid and/or saturated fatty acid. In some embodiments, the removing at least a portion of the base oil or a composition comprising two or more estolide compounds is accomplished by use of at least one of distillation, chromatography, membrane separation, phase separation, affinity separation, and solvent extraction. In some embodiments, the distillation takes place at a temperature and/or pressure that is suitable to separate the estolide base oil or a composition comprising two or more estolide compounds into different "cuts" that individually exhibit different EN values. In some embodiments, this may be accomplished by subjecting the base oil or a composition comprising two or more estolide compounds to a temperature of at least about 250° C. and an absolute pressure of no greater than about 25 microns. In some embodiments, the distillation takes place at a temperature range of about 250° C. to about 310° C. and an absolute pressure range of about 10 microns to about 25 microns.

In some embodiments, estolide compounds and compositions exhibit an EN that is greater than or equal to 1, such as an integer or fraction of an integer selected from about 1.0 to about 2.0. In some embodiments, the EN is an integer or fraction of an integer selected from about 1.0 to about 1.6. In some embodiments, the EN is a fraction of an integer selected from about 1.1 to about 1.5. In some embodiments, the EN is selected from a value greater than 1.0, 1.1, 1.2, 1.3, 1.4, 1.5, 1.6, 1.7, 1.8, and 1.9. In some embodiments, the EN is selected from a value less than 1.1, 1.2, 1.3, 1.4, 1.5, 1.6, 1.7, 1.8, 1.9, and 2.0.

In some embodiments, the EN is greater than or equal to 1.5, such as an integer or fraction of an integer selected from about 1.8 to about 2.8. In some embodiments, the EN is an integer or fraction of an integer selected from about 2.0 to about 2.6. In some embodiments, the EN is a fraction of an integer selected from about 2.1 to about 2.5. In some embodiments, the EN is selected from a value greater than 1.8, 1.9, 2.0, 2.1, 2.2, 2.3, 2.4, 2.5, 2.6, and 2.7. In some embodiments, the EN is selected from a value less than 1.9, 2.0, 2.1, 2.2, 2.3, 2.4, 2.5, 2.6, 2.7, and 2.8. In some embodiments, the EN is about 1.8, 2.0, 2.2, 2.4, 2.6, or 2.8.

In some embodiments, the EN is greater than or equal to about 4, such as an integer or fraction of an integer selected from about 4.0 to about 5.0. In some embodiments, the EN is a fraction of an integer selected from about 4.2 to about 4.8. In some embodiments, the EN is a fraction of an integer selected from about 4.3 to about 4.7. In some embodiments, the EN is selected from a value greater than 4.0, 4.1, 4.2, 4.3, 4.4, 4.5, 4.6, 4.7, 4.8, and 4.9. In some embodiments, the EN is selected from a value less than 4.1, 4.2, 4.3, 4.4, 4.5, 4.6, 4.7, 4.8, 4.9, and 5.0. In some embodiments, the EN is about 4.0, 4.2, 4.4, 4.6, 4.8, or 5.0.

In some embodiments, the EN is greater than or equal to about 5, such as an integer or fraction of an integer selected from about 5.0 to about 6.0. In some embodiments, the EN is a fraction of an integer selected from about 5.2 to about 5.8. In some embodiments, the EN is a fraction of an integer selected from about 5.3 to about 5.7. In some embodiments, the EN is selected from a value greater than 5.0, 5.1, 5.2, 5.3, 5.4, 5.5, 5.6, 5.7, 5.8, and 5.9. In some embodiments, the EN is selected from a value less than 5.1, 5.2, 5.3, 5.4, 5.5, 5.6, 5.7, 5.8, 5.9, and 6.0. In some embodiments, the EN is about 5.0, 5.2, 5.4, 5.4, 5.6, 5.8, or 6.0.

In some embodiments, the EN is greater than or equal to 1, such as an integer or fraction of an integer selected from about 1.0 to about 2.0. In some embodiments, the EN is less than or equal to 2, such as an integer or fraction of an integer selected from about 1.0 to about 2.0. In some embodiments, the EN is less than or equal to 1.8 or even 1.5, such as an integer or fraction of an integer selected from about 1.0 to about 1.5. In some embodiments, the EN is a fraction of an integer selected from about 1.1 to about 1.7. In some embodiments, the EN is a fraction of an integer selected from about 1.1 to about 1.5. In some embodiments, the EN is selected from a value greater than 1.0, 1.1, 1.2, 1.3, 1.4, 1.5, 1.6, 1.7, 1.8, or 1.9. In some embodiments, the EN is selected from a value less than 1.2, 1.3, 1.4, 1.5, 1.6, 1.7, 1.8, 1.9, or 2.0. In some embodiments, the EN is about 1.0, 1.2, 1.4, 1.6, 1.8, or 2.0. In some embodiments, the EN is greater than or equal to 1, such as an integer or fraction of an integer selected from about 1.2 to about 2.2. In some embodiments, the EN is an integer or fraction of an integer selected from about 1.4 to about 2.0. In some embodiments, the EN is a fraction of an integer selected from about 1.5 to about 1.9. In some embodiments, the EN is selected from a value greater than 1.0, 1.1. 1.2, 1.3, 1.4, 1.5, 1.6, 1.7, 1.8, 1.9, 2.0, and 2.1. In some embodiments, the EN is selected from a value less than 1.2, 1.3, 1.4, 1.5, 1.6, 1.7, 1.8, 1.9, 2.0, 2.1, and 2.2. In some embodiments, the EN is about 1.0, 1.2, 1.4, 1.6, 1.8, 2.0, or 2.2.

In some embodiments, the EN is greater than or equal to 2, such as an integer or fraction of an integer selected from about 2.8 to about 3.8. In some embodiments, the EN is an integer or fraction of an integer selected from about 2.9 to about 3.5. In some embodiments, the EN is an integer or fraction of an integer selected from about 3.0 to about 3.4. In some embodiments, the EN is selected from a value greater than 2.0, 2.1, 2.2, 2.4, 2.5, 2.6, 2.7, 2.8, 2.9, 3.0, 3.1, 3.4, 3.5, 3.6, and 3.7. In some embodiments, the EN is selected from a value less than 2.2, 2.3, 2.4, 2.5, 2.6, 2.7, 2.8, 2.9, 3.0, 3.1, 3.2, 3.3, 3.4, 3.5, 3.6, 3.7, and 3.8. In some embodiments, the EN is about 2.0, 2.2, 2.4, 2.6, 2.8, 3.0, 3.2, 3.4, 3.6, or 3.8.

Typically, base stocks and estolide-containing compositions exhibit certain lubricity, viscosity, and/or pour point characteristics. For example, in certain embodiments, the base oils, compounds, and compositions may exhibit viscosities that range from about 10 cSt to about 250 cSt at 40° C., and/or about 3 cSt to about 30 cSt at 100° C. In some embodiments, the base oils, compounds, and compositions may exhibit viscosities within a range from about 50 cSt to about 150 cSt at 40° C., and/or about 10 cSt to about 20 cSt at 100° C.

In some embodiments, the estolide compounds and compositions may exhibit viscosities less than about 55 cSt at 40° C. or less than about 45 cSt at 40° C., and/or less than about 12 cSt at 100° C. or less than about 10 cSt at 100° C. In some embodiments, the estolide compounds and compositions may exhibit viscosities within a range from about 25 cSt to about 55 cSt at 40° C., and/or about 5 cSt to about 11 cSt at 100° C. In some embodiments, the estolide compounds and compositions may exhibit viscosities within a range from about 35 cSt to about 45 cSt at 40° C., and/or about 6 cSt to about 10 cSt at 100° C. In some embodiments, the estolide compounds and compositions may exhibit viscosities within a range from about 38 cSt to about 43 cSt at 40° C., and/or about 7 cSt to about 9 cSt at 100° C.

In some embodiments, the estolide compounds and compositions may exhibit viscosities less than about 120 cSt at 40° C. or less than about 100 cSt at 40° C., and/or less than about 18 cSt at 100° C. or less than about 17 cSt at 100° C. In some embodiments, the estolide compounds and compositions may exhibit a viscosity within a range from about 70 cSt to about 120 cSt at 40° C., and/or about 12 cSt to about 18 cSt at 100° C. In some embodiments, the estolide compounds and compositions may exhibit viscosities within a range from about 80 cSt to about 100 cSt at 40° C., and/or about 13 cSt to about 17 cSt at 100° C. In some embodiments, the estolide compounds and compositions may exhibit viscosities within a range from about 85 cSt to about 95 cSt at 40° C., and/or about 14 cSt to about 16 cSt at 100° C.

In some embodiments, the estolide compounds and compositions may exhibit viscosities greater than about 180 cSt at 40° C. or greater than about 200 cSt at 40° C., and/or greater than about 20 cSt at 100° C. or greater than about 25 cSt at 100° C. In some embodiments, the estolide compounds and compositions may exhibit a viscosity within a range from about 180 cSt to about 230 cSt at 40° C., and/or about 25 cSt to about 31 cSt at 100° C. In some embodiments, the estolide compounds and compositions may exhibit viscosities within a range from about 200 cSt to about 250 cSt at 40° C., and/or about 25 cSt to about 35 cSt at 100° C. In some embodiments, the estolide compounds and compositions may exhibit viscosities within a range from about 210 cSt to about 230 cSt at 40° C., and/or about 28 cSt to about 33 cSt at 100° C. In some embodiments, the estolide compounds and compositions may exhibit viscosities within a range from about 200 cSt to about 220 cSt at 40° C., and/or about 26 cSt to about 30 cSt at 100° C. In some embodiments, the estolide compounds and compositions may exhibit viscosities within a range from about 205 cSt to about 215 cSt at 40° C., and/or about 27 cSt to about 29 cSt at 100° C.

In some embodiments, the estolide compounds and compositions may exhibit viscosities less than about 45 cSt at 40° C. or less than about 38 cSt at 40° C., and/or less than about 10 cSt at 100° C. or less than about 9 cSt at 100° C. In some embodiments, the estolide compounds and compositions may exhibit a viscosity within a range from about 20 cSt to about 45 cSt at 40° C., and/or about 4 cSt to about 10 cSt at 100° C. In some embodiments, the estolide compounds and compositions may exhibit viscosities within a range from about 28 cSt to about 38 cSt at 40° C., and/or about 5 cSt to about 9 cSt at 100° C. In some embodiments, the estolide compounds and compositions may exhibit viscosities within a range from about 30 cSt to about 35 cSt at 40° C., and/or about 6 cSt to about 8 cSt at 100° C.

In some embodiments, the estolide compounds and compositions may exhibit viscosities less than about 80 cSt at 40° C. or less than about 70 cSt at 40° C., and/or less than about 14 cSt at 100° C. or less than about 13 cSt at 100° C. In some embodiments, the estolide compounds and compositions may exhibit a viscosity within a range from about 50 cSt to about 80 cSt at 40° C., and/or about 8 cSt to about 14 cSt at 100° C. In some embodiments, the estolide compounds and compositions may exhibit viscosities within a range from about 60 cSt to about 70 cSt at 40° C., and/or about 9 cSt to about 13 cSt at 100° C. In some embodiments, the estolide compounds and compositions may exhibit viscosities within a range from about 63 cSt to about 68 cSt at 40° C., and/or about 10 cSt to about 12 cSt at 100° C.

In some embodiments, the estolide compounds and compositions may exhibit viscosities greater than about 120 cSt at 40° C. or greater than about 130 cSt at 40° C., and/or greater than about 15 cSt at 100° C. or greater than about 18 cSt at 100° C. In some embodiments, the estolide compounds and compositions may exhibit a viscosity within a range from about 120 cSt to about 150 cSt at 40° C., and/or about 16 cSt to about 24 cSt at 100° C. In some embodiments, the estolide compounds and compositions may exhibit viscosities within a range from about 130 cSt to about 160 cSt at 40° C., and/or about 17 cSt to about 28 cSt at 100° C. In some embodiments, the estolide compounds and compositions may exhibit viscosities within a range from about 130 cSt to about 145 cSt at 40° C., and/or about 17 cSt to about 23 cSt at 100° C. In some embodiments, the estolide compounds and compositions may exhibit viscosities within a range from about 135 cSt to about 140 cSt at 40° C., and/or about 19 cSt to about 21 cSt at 100° C. In some embodiments, the estolide compounds and compositions may exhibit viscosities of about 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 55, 60, 65, 70, 75, 80, 85, 90, 95, 100, 110, 120, 130, 140, 150, 160, 170, 180, 190, 200, 210, 220, 230, 240, 250, 260, 270, 280, 290, 300, 350, or 400 cSt. at 40° C. In some embodiments, the estolide compounds and compositions may exhibit viscosities of about 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30 cSt at 100° C.

In some embodiments, the estolide compounds and compositions may exhibit viscosities less than about 200, 250, 300, 350, 400, 450, 500, or 550 cSt at 0° C. In some embodiments, the estolide compounds and compositions may exhibit a viscosity within a range from about 200 cSt to about 250 cSt at 0° C. In some embodiments, the estolide compounds and compositions may exhibit a viscosity within a range from about 250 cSt to about 300 cSt at 0° C. In some embodiments, the estolide compounds and compositions may exhibit a viscosity within a range from about 300 cSt to about 350 cSt at 0° C. In some embodiments, the estolide compounds and compositions may exhibit a viscosity within a range from about 350 cSt to about 400 cSt at 0° C. In some embodiments, the estolide compounds and compositions may exhibit a viscosity within a range from about 400 cSt to about 450 cSt at 0° C. In some embodiments, the estolide compounds and compositions may exhibit a viscosity within a range from about 450 cSt to about 500 cSt at 0° C. In some embodiments, the estolide compounds and compositions may exhibit a viscosity within a range from about 500 cSt to about 550 cSt at 0° C. In some embodiments, the estolide compounds and compositions may exhibit viscosities of about 100, 125, 150, 175, 200, 225, 250, 275, 300, 325, 350, 375, 400, 425, 450, 475, 500, 525, or 550 cSt at 0° C.

In some embodiments, estolide compounds and compositions may exhibit desirable low-temperature pour point properties. In some embodiments, the estolide compounds and compositions may exhibit a pour point lower than about −20° C., about −25° C., about −35° C., −40° C., or even about −50° C. In some embodiments, the estolide compounds and compositions have a pour point of about −25° C. to about −45° C. In some embodiments, the pour point falls within a range of about −30° C. to about −40° C., about −34° C. to about −38° C., about −30° C. to about −45° C., −35° C. to about −45° C., 34° C. to about −42° C., about −38° C. to about −42° C., or about 36° C. to about −40° C. In some embodiments, the pour point falls within the range of about −27° C. to about −37° C., or about −30° C. to about −34° C. In some embodiments, the pour point falls within the range of about −25° C. to about −35° C., or about −28° C. to about −32° C. In some embodiments, the pour point falls within the range of about −28° C. to about −38° C., or about −31° C. to about −35° C. In some embodiments, the pour point falls within the range of about −31° C. to about −41° C., or about −34° C. to about −38° C. In some embodiments, the pour point falls within the range of about −40° C. to about −50° C., or about −42° C. to about −48° C. In some embodiments, the pour point falls within the range of about −50° C. to about −60° C., or about −52° C. to about −58° C. In some embodiments, the upper bound of the pour point is less than about −35° C., about −36° C., about −37° C., about −38° C., about −39° C., about −40° C., about −41° C., about −42° C., about −43° C., about −44° C., or about −45° C. In some embodiments, the lower bound of the pour point is greater than about −70° C., about −69° C., about −68° C., about −67° C., about −66° C., about −65° C., about −64° C., about −63° C., about −62° C., about −61° C., about −60° C., about −59° C., about −58° C., about −57° C., about −56° C., −55° C., about −54° C., about −53° C., about −52° C., −51, about −50° C., about −49° C., about −48° C., about −47° C., about −46° C., or about −45° C.

In addition, in certain embodiments, the estolides may exhibit decreased Iodine Values (IV) when compared to estolides prepared by other methods. IV is a measure of the degree of total unsaturation of an oil, and is determined by measuring the amount of iodine per gram of estolide (cg/g). In certain instances, oils having a higher degree of unsaturation may be more susceptible to creating corrosiveness and deposits, and may exhibit lower levels of oxidative stability. Compounds having a higher degree of unsaturation will have more points of unsaturation for iodine to react with, resulting in a higher IV. Thus, in certain embodiments, it may be desirable to reduce the IV of estolides in an effort to increase the oil's oxidative stability, while also decreasing harmful deposits and the corrosiveness of the oil.

In some embodiments, estolide compounds and compositions described herein have an IV of less than about 40 cg/g or less than about 35 cg/g. In some embodiments, estolides have an IV of less than about 30 cg/g, less than about 25 cg/g, less than about 20 cg/g, less than about 15 cg/g, less than about 10 cg/g, or less than about 5 cg/g. In some embodiments, estolides have an IV of about 0 cg/g. The IV of a composition may be reduced by decreasing the estolide's degree of unsaturation. This may be accomplished by, for example, by increasing the amount of saturated capping materials relative to unsaturated capping materials when synthesizing the estolides. Alternatively, in certain embodiments, IV may be reduced by hydrogenating estolides having unsaturated caps.

In some embodiments, the estolide compounds described herein may be useful as base oil in lubricant compositions, such as engine oil formulations. In certain embodiments, the estolide base oil comprises greater than 0% to about 95% by weight of the overall composition, such as about 5% to about 90%, about 5% to about 85%, about 10% to about 75%, about 10% to about 50%, about 15% to about 65%, about 20% to about 55%, about 25% to about 60%, about 25% to about 55%, about 25% to about 40%, about 30% to about 40%, about 30% to about 45%, about 32% to about 38%, or even about 33% to about 36% by weight of the composition. In certain embodiments, the estolide base oil comprises at least 25% by weight of the composition.

In certain embodiments, the composition further comprises at least one non-estolide base oil. In certain embodiments, the at least one non-estolide base oil is selected from a mineral oil, a synthetic oil, or a semi-synthetic oil. Exemplary mineral oils include, but are not limited to, base stocks referred to as Group I (solvent refined mineral oils) and Group II (hydro cracked mineral oils) oils. Exemplary semi-synthetic oils include, but are not limited to, Group III (severely hydro cracked oil) oils. Exemplary synthetic oils include, but are not limited to, esters, polyolefins, and naphthenes. In certain embodiments, the at least one non-estolide comprises greater than 0% to about 95% by weight of the overall composition, such as about 5% to about 85%, about 10% to about 75%, about 15% to about 70%, about 15% to about 65%, about 20% to about 55%, about 25% to about 55%, about 30% to about 65%, about 30% to about 45%, about 40% to about 55%, or even about 32% to about 38% by weight of the composition.

In certain embodiments, the at least one non-estolide base oil is a mineral oil. Exemplary mineral oils include, but are not limited to, white mineral oils, paraffinic oils, and naphthenic oils, such as Group I and Group II paraffinic oils In certain embodiments, the composition comprises a synthetic oil selected from one or more of hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-octenes), or poly(1-decenes)); alkylbenzenes (e.g., dodecylbenzenes, tetradecylbenzenes, dinonylbenzenes, or di-(2-ethylhexyl)benzenes); polyphenyls (e.g., biphenyls, terphenyls, or alkylated polyphenyl), alkylated diphenyl ethers, alkylated diphenyl sulfides, and the derivatives, analogs or homologs thereof. In certain embodiments, the synthetic oil is a polyalphaolefin (PAO). Exemplary PAOs include, but are not limited to, PAO2, PAO4, PAO6, PAO8, PAO9, PAO10, PAO40, and PAO100.

In certain embodiments, the synthetic oil comprises one or more alkylene oxide polymers and interpolymers and derivatives thereof, wherein the terminal hydroxyl groups have been modified by esterification or etherification. Exemplary oils may be prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol have a molecular weight of about 500 to about 1000, diethyl ether of polypropylene glycol having a molecular weight of about 1000 to about 1500), or mono- and polycarboxylic esters thereof, for example, acetic acid esters, mixed $C_3$-$C_8$ fatty acid esters, or diesters of tetraethylene glycol.

In certain embodiments, the synthetic oil is a non-estolide ester. Exemplary esters include, but are not limited to, esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, or alkenyl malonic acids) with any suitable alcohol (e.g., butyl alcohol, hexyl alcohol, dodecyl alcohol, 2-ethylhexyl alcohol, ethylene glycol, diethylene glycol monoether, or propylene glycol). Exemplary esters include dibutyl adipate, di(2-ethylhexyl) sebacate, di-hexyl fumarate, dioctyl sebacate, diisooctyl azelate, diisodecyl azealate, dioctyl phthalate, didecyl phthalate, dicicosyl sebacate, the 2-ethylhexyl diester of linoleic acid dimer, and the complex ester formed by reacting one mole of sebacic acid with two moles of tetraethylene glycol and two moles of 2-ethylhexanoic acid.

In certain embodiments, the synthetic oil is a polyol ester made from one or more esters derived from $C_5$ to $C_{12}$ monocarboxylic acids and polyols and polyol ethers such as neopentyl glycol, trimethylolpropane, pentaerythritol, dipentaerythritol, and tripentaerythritol. Other synthetic oils include liquid esters of phosphorus-containing acids (e.g., tricresyl phosphate, trioctyl phosphate, and the diethyl ester of decylphosphonic acid), and polymeric tetrahydrofurans.

In certain embodiments, the at least one non-estolide base oil is a semi-synthetic oil. In certain embodiments, the semi-synthetic oil is a mineral oil that has been subjected to hydrogenation or hydrocracking under special conditions to remove, e.g., undesirable chemical compositions and impurities to provide a base oil having synthetic oil components and properties. In certain embodiments, the semi-synthetic oil is a Group III petroleum base oil. In certain embodiments, the Group III oil has a sulfur level less than 0.03%, with saturates greater than or equal to 90% and a viscosity index of greater than or equal to 120. Exemplary Group III oils include, but are not limited to, the Yubase® line of products marketed by SK Lubricants Co., Ltd., such as Yubase 4, Yubase 5, Yubase 6, and Yubase 8.

In certain embodiments, the composition comprises one or more estolide compounds and a lubricant additive package containing one or more additional additives. Exemplary additive packages may include one or more components selected from solvents, viscosity index improvers, corrosion inhibitors, oxidation inhibitors, dispersants, lube oil flow improvers, detergents and rust inhibitors, pour point depressants, anti-foaming agents, antiwear agents, seal swellants, or friction modifiers.

In some cases, dissolution of the additives into the base oil may be facilitated by solvents and by mixing accompanied with mild heating. In some embodiments, the compositions described herein can employ greater than 0 wt. % up to about 95 wt. % of the additive package, with the remainder being the estolide base oil. In some embodiments, the estolide base oil may comprise from about 1 to about 95 wt. %, about 10 to about 80 wt. %, about 25 to about 75 wt. %, about 30 to about 60 wt. %, or about 40 to about 50 wt. % of the composition.

Unless otherwise indicated, all of the weight percentages expressed herein is based on the content of the overall composition, which will be the sum of the additives plus the weight of the base oil(s).

In certain embodiments, the composition comprises at least one corrosion inhibitor. Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, optionally in the presence of an alkylated phenol or of an alkylphenol thioester, and also optionally in the presence of carbon dioxide.

In certain embodiments, the composition comprises further at least one antioxidant. Oxidation inhibitors, or antioxidants, reduce the tendency of base oils to deteriorate in service which deterioration can be evidenced by the products of oxidation such as sludge and varnish-like deposits on the metal surfaces, and by viscosity growth. Such oxidation inhibitors include alkaline earth metal salts of alkyl-phenolthioesters having, for example, $C_5$ to $C_{12}$ alkyl side chains, such as calcium nonylphenol sulfide, barium t-octylphenol sulfide, dioctylphenylamine, phenylalphanaphthylamine, or phosphosulfurized or sulfurized hydrocarbons. Also included are oil soluble antioxidant copper compounds such as copper salts of $C_{10}$-$C_{18}$ oil soluble fatty acids. In certain embodiments, the at least one antioxidant is selected from phenolic antioxidants, amine antioxidants, or organometallic antioxidants. In certain embodiments, the at least one antioxidant is a phenolic antioxidant. In certain embodiments, the at least one antioxidant is a hindered phenolic antioxidant. In certain embodiments, the at least one antioxidant is an amine antioxidant, such as a diarylamine, benzylamine, or polyamine. In certain embodiments, the at least one antioxidant is a diarylamine antioxidant, such as an alkylated diphenylamine antioxidant. In certain embodiments, the at least one antioxidant is a phenyl-α-naphthylamine or an alkylated phenyl-α-naphthylamine. In certain embodiments, the at least one antioxidant comprises an antioxidant package. In certain embodiments, the antioxidant package comprises one or more phenolic antioxidants and one or more amine antioxidants, such as a combination of a hindered phenolic antioxidant and an alkylated diphenylamine antioxidant. In some embodiments, the antioxidant may be present in amounts of about 0% to about 10% by weight, or about 0% to about 5% by weight of the composition, such as about 0.01% to about 3%, about 0.1% to about 2%, or about 0.5% to about 1.5%. In certain embodiments, the antioxidant comprises at least 0.1% by weight of the composition.

In certain embodiments, the composition further comprises at least one friction modifier. Representative examples of suitable friction modifiers may include fatty acid esters and amides, molybdenum complexes of polyisobutenyl succinic anhydride-amino alkanols, glycerol esters of dimerized fatty acids, alkane phosphonic acid salts, phosphonate with an oleamide, S-carboxyalkylene hydrocarbyl succinimide, N(hydroxylalkyl)alkenylsuccinamic acids or succinimides, di-(lower alkyl) phosphites and epoxides, and alkylene oxide adduct of phosphosulfurized N(hydroxyalkyl)alkenyl succinimides. Suitable friction modifiers may include succinate esters, or metal salts thereof, of hydrocarbyl substituted succinic acids or anhydrides and thiobis-alkanols.

In certain embodiments, the composition further comprises at least one dispersant. Dispersants may be used to maintain oil insolubles, resulting from oxidation during use, in suspension in the fluid thus preventing sludge flocculation and precipitation or deposition on metal parts. Suitable dispersants may include high molecular weight alkyl succinimides, the reaction product of oil-soluble polyisobutylene succinic anhydride with ethylene amines such as tetraethylene pentamine and borated salts thereof.

Dispersants of the ashless type can also be used in the compositions described herein. An exemplary ashless dispersant is a derivatized hydrocarbon composition which is mixed with at least one of amine, alcohol, including polyol, or aminoalcohol. Derivatized hydrocarbon dispersants may be the product of reacting (1) a functionalized hydrocarbon of less than 500 Mn (number average molecular weight) wherein functionalization comprises at least one group of the formula —CO—Y—$R_3$ wherein Y is O or S; $R_3$ is H, hydrocarbyl, aryl, substituted aryl or substituted hydrocarbyl and wherein at least 50 mole % of the functional groups are attached to a tertiary carbon atom; and (2) a nucleophilic reactant; wherein at least about 80% of the functional groups originally present in the functionalized hydrocarbon are derivatized.

In certain embodiments, the composition further comprises at least one pour-point depressant. Pour-point depressants, also known as lube oil flow improvers, can lower the temperature at which the fluid will flow. Exemplary additives include $C_8$-$C_{18}$ dialkyl fumarate vinyl acetate copolymers, polymethacrylates and wax naphthalene. In certain embodiments, the at least one pour-point depressant comprises about 0.01 to about 1% by weight of the composition, such as about 0.1 to about 0.5%.

In certain embodiments, the composition further comprises at least one foam control (antifoam) agent. Foam control can also be provided by an anti-foamant of the polysiloxane type such as silicone oil and polydimethyl siloxane.

In certain embodiments, the composition further comprises at least one anti-wear agent. Anti-wear agents reduce wear of metal parts, and representative materials include zinc alkyl dithiophosphates such as dialkyldithiophosphate, and zinc diaryl diphosphates. Also included are ashless zinc replacements, including boron-type antiwear compounds. Exemplary ashless boron-type compounds include, but are not limited to, borated nitrogen compounds such as a borated polyalkenyl succinimide.

In certain embodiments, the composition further comprises at least one detergent and/or metal rust inhibitor ("Detergent inhibitor"). Detergents and metal rust inhibitors include the metal salts of sulfonic acids, alkylphenols, sulfurized alkylphenols, alkyl salicylates, naphthenates and other oil soluble mono- and dicarboxylic acids. Exemplary sulfonates include metal salts of optionally substituted carbocyclic sulfonic acids, optionally substituted aryl sulfonic acids, or aliphatic sulfonic acids. In certain embodiments, the detergent inhibitor comprises a metal salt of an alkylaryl sulfonic acid, such as a calcium long-chain alkylaryl sulfonate. Neutral or highly basic metal salts such as highly basic alkaline earth metal sulfonates (such as calcium and magnesium salts) may be used as such detergents. In certain embodiments, the detergent inhibitor comprises a calcium detergent, such as a calcium sulfonate, a calcium phenate, or a calcium salicylate. In certain embodiments, the detergent inhibitor is an overbased detergent, such as an overbased calcium compound. In certain embodiments, the detergent inhibitor has a total base number of about 25 to about 600, such as about 30 to about 60, about 40 to about 80, about 100 to about 500, or about 150 to about 450, as expressed in mg KOH/g of the detergent composition. In certain embodiments, the detergent inhibitor is a nonylphenol sulfide. Exemplary materials may be prepared by reacting an alkylphenol with commercial sulfur dichlorides. Suitable alkylphenol sulfides can also be prepared by reacting alkylphenols with elemental sulfur. Other suitable detergent inhibitors may include neutral and basic salts of phenols, generally known as phenates, wherein the phenol is generally an alkyl substituted phenolic group, where the substituent is an aliphatic hydrocarbon group having about 4 to 400 carbon atoms. Exemplary detergent inhibitors may include, for example, "S911" and "P5710" sold by Infineum USA of Linden, N.J. In some embodiments, the detergent inhibitor comprises from about 0.1 wt. % to about 20 wt. %, about 2 wt. % to about 18 wt. %, about 5 wt. % to about 15 wt. %, or about 11 wt. % to about 13 wt. % of the composition. In some embodiments, the detergent inhibitor comprises at least 10 wt. % of the composition.

In certain embodiments, the composition further comprises at least one viscosity modifier. Viscosity modifiers may impart high and low temperature operability to the lubricating oil and permit it to remain shear stable at elevated temperatures and also exhibit acceptable viscosity or fluidity at low temperatures. Exemplary viscosity modifiers may include high molecular weight hydrocarbon polymers including polyesters. The viscosity modifiers may also be derivatized to include other properties or functions, such as the addition of dispersancy properties. Representative examples of suitable viscosity modifiers include: polybutenes; polyisobutylenes (PIB); copolymers of ethylene and propylene; polymethacrylates; methacrylate copolymers; copolymers of an unsaturated dicarboxylic acid and vinyl compound; styrene-type polymers including, but not limited to, interpolymers of styrene and acrylic esters, and copolymers of styrene/isoprene, and/or styrene/butadiene, and partially-hydrogenated variants thereof; and isoprene/butadiene, such as the partially hydrogenated homopolymers of butadiene and isoprene. Exemplary viscosity modifiers include styrene-diene type polymers, such as the SV277 viscosity modifier additive sold by Infineum USA of Linden, N.J. In some embodiments, the at least one viscosity modifier comprises from about 0 wt. % to about 75 wt. % or about 5 wt. % to about 60 wt. % of the composition, such as about 0.1 wt. % to about 15 wt. %, about 1 wt. % to about 10 wt. %, or about 2 wt. % to about 5 wt. % of the composition. In some embodiments, the viscosity modifier comprises at least 10 wt. % of the composition.

In some embodiments, the compositions comprise at least one polybutene polymer. In some embodiments, the polybutene may comprise a mixture of poly-n-butenes and polyisobutylene, which may result from the polymerization of $C_4$ olefins and generally will have a number average molecular weight of about 300 to 1500, or a polyisobutylene or polybutene having a number average molecular weight of about 400 to 1300. In some embodiments, the polybutene and/or polyisobutylene may have a number average molecular weight of about 950 Mn may be measured by gel permeation chromatography. Polymers composed of 100% polyisobutylene or 100% poly-n-butene should be understood to fall within the scope of this disclosure and within the meaning of the term "a polybutene polymer". An exemplary polyisobutylene includes "PIB S1054" which has an Mn of about 950 and is sold by Infineum USA of Linden, N.J.

In some embodiments, the at least one polybutene polymer comprises a mixture of polybutenes and polyisobutylene prepared from a $C_4$ olefin refinery stream containing about 6 wt. % to about 50 wt. % isobutylene with the balance a mixture of butene (cis- and trans-) isobutylene and less than 1 wt %. butadiene. For example, the polymer may be prepared via Lewis acid catalysis from a $C_4$ stream composed of 6-45 wt. % isobutylene, 25-35 wt. % saturated butenes and 15-50 wt. % 1- and 2-butenes.

In certain embodiments, the composition further comprises at least one solvent. Suitable solvents may generally be characterized as being normally liquid petroleum or synthetic hydrocarbon solvents having a boiling point not higher than about 300° C. at atmospheric pressure. Such a solvent may also have a flash point in the range of about 60-120° C. Typical examples include kerosene, hydrotreated kerosene, middle distillate fuels, isoparaffinic and naphthenic aliphatic hydrocarbon solvents, dimers, and higher oligomers of propylene butene and similar olefins as well as paraffinic and aromatic hydrocarbon solvents and mixtures thereof. Such solvents may contain functional groups other than carbon and hydrogen provided such groups do not adversely affect performance of the composition. Suitable solvents include naphthenic type hydrocarbon solvents having a boiling point range of about 91.1° C. to about 113.9° C., such as "Exxsol D80" sold by Exxon Chemical Company. In some embodiments, the composition comprises from about 0 wt. % to about 75 wt. %, about 5 wt. % to about 60 wt. %, about 10 wt. % to about 50 wt. %, about 15 wt. % to about 40 wt. %, about 20 wt. % to about 30 wt. %, or about 23 wt. % to about 27 wt. % of the at least one solvent.

In certain embodiments, the composition comprises an estolide base oil having a kinematic viscosity equal to or less than about 12 cSt when measured at 100° C. In certain embodiments, the composition comprises an estolide base oil having a kinematic viscosity equal to or less than about 11 cSt when measured at 100° C. In certain embodiments, the composition comprises an estolide base oil having a kinematic viscosity equal to or less than about 10 cSt when measured at 100° C., such as about 1 to about 10, about 2 to about 9, about 4 to about 9, or about 5 to about 10 cSt at 100° C.

In certain embodiments, the estolide base oil comprises the balance of the composition after addition of the components of the additive package. In certain embodiments, the estolide base oil comprises about 1 to about 95% by weight of the composition, such as about 1 to about 69 wt. %, about 15 to about 65 wt. %, about 25 to about 60 wt. %, about 35 to about 55 wt. %, about 40 to about 50 wt. %, or about 42 to about 46 wt. %.

The present disclosure is based on the surprising discovery that certain combinations of additive packages and estolide base stocks can provide engine oil compositions exhibiting properties that meet or exceed certain guidelines for the lubricant quality and performance according to the American Petroleum Institute (API), including International Lubricant Standardization and Approval Committee (ILSAC) GF-5 limits set for Sequence IIIG, Sequence VG, Sequence IVA, Sequence VIII, and/or Sequence VID testing conditions.

The Sequence IIIG is a fired engine test designed to evaluate a candidate oil's performance in three areas: viscosity increase; high temperature piston deposits; and valve train wear. For GF-5, the performance parameters are: viscosity increase as a percentage of new oil (PVISFNL); viscosity; weighted piston deposits; cam and lifter wear (ACLWFNL); and hot stuck rings. The Sequence IIIG testing is conducted using ASTM Method D7320 as follows:

| | |
|---|---|
| Engine | GM 3.8L (3800 cc) V-6 |
| Test length (h) | 100 |
| Speed (rpm) | 3600 |
| Load (Nm) | 250 |
| Oil Temp. (° C.) | 155 |
| Coolant Temp. (° C.) | 115 |
| Intake Air Temp. (° C.) | 35 |
| Valve Spring Load (lbs) | 205 @ 0.375 inch deflection |
| Air/Fuel Ratio | 15:1 |
| Initial Oil Charge (mL) | 5500 |
| Oil check and samples (h) | 0, 20, 40, 60, 80, and 100 |
| Camshaft | Nodular cast iron (phosphate) |
| Cam Bushing | Babbit |
| Lifters | Alloy cast iron |
| Fuel | Haltermann fuel unleaded |

Sequence IIIGA testing merits include those that measure for low temperature used oil viscosity (MRV) and used oil cold crank simulator (CCS), per ASTM Method 7528. Sequence IIIGB testing merits include that for phosphorous retention, per ASTM Method 7320. In certain embodiments, the engine oil compositions described herein meet or exceed one or more of the GF-5 limits set for certain Sequence IIIG testing procedures. In certain embodiments, the formulations meet or exceed all of the GF-5 performance limits described herein.

In certain embodiments, the composition may exhibit an ACLWFNL Wear Rating (μm) of 60 or less, such as ≤50, ≤40, ≤35, ≤25, ≤15, or even ≤10. In certain embodiments, the compositions described may exhibit an ACLWFNL Wear Rating (μm) of about 0 to about 60, such as about 0 to about 30, about 1 to about 25, about 5 to about 20, about 5 to about 15, or even about 10 to about 15.

In certain embodiments, the composition may exhibit a PVISFNL Viscosity Increase (% @ 40° C.) of 150 or less, such as ≤125, ≤100, ≤85, ≤65, or even ≤50. In certain embodiments, the compositions described may exhibit a PVISFNL Viscosity Increase (% @ 40° C.) of about 0 to about 150, such as about 10 to about 125, such as about 5 to about 100, about 25 to about 100, such as about 25 to about 85, about 35 to about 85, about 45 to about 65, or even about 40 to about 60.

In certain embodiments, the composition may exhibit a Weighted Piston Deposit (merits) of ≥4, ≥5, ≥6, ≥7, ≥8, or ≥9. In certain embodiments, the compositions described may exhibit a Weighted Piston Deposit (merits) of about 6.5 to about 10, such as about 7 to about 9.5, about 8 to about 9, or even about 8.2 to about 8.8.

In certain embodiments, the composition may exhibit IIIGB—Phosphorous Retention of ≥80%, ≥85%, or ≥90%. In some embodiments, the compositions described may exhibit IIIGB—Phosphorous Retention of about 80% to about 100%, such as about 80% to about 90%.

In certain embodiments, the composition may exhibit IIIGA—Used Oil MRV (cP @−30° C.) of 60,000 or less, such as ≤50,000, ≤40,000, ≤30,000, ≤25,000, or even ≤20,000. In certain embodiments, the compositions described may exhibit IIIGA—Used Oil MRV (cP @−30° C.) of about 5,000 to about 50,000, such as about 10,000 to about 40,000, about 15,000 to about 35,000, or about 20,000 to about 30,000.

In certain embodiments, the composition may exhibit IIIGA—Used Oil CCS (cP @−25° C.) of 7,000 or less, such as ≤6,500, ≤6,000, ≤5,000, ≤4,000, or even ≤3,000. In certain embodiments, the compositions described may exhibit IIIGA—Used Oil MRV (cP @−25° C.) of about 2,000 to about 7,000, such as about 4,000 to about 7,000, about 5,000 to about 7,000, or about 6,000 to about 6,800.

The Sequence VG is a fired engine test designed to evaluate a candidate oil's performance in three areas: wear; sludge; and varnish. For GF-5, the performance parameters are evaluated per ASTM Method D6593 for: engine sludge; rocker cover sludge; engine varnish; piston skirt varnish; oil screen sludge; oil screen debris; hot stuck compression rings; cold stuck rings; and oil ring clogging. The test engine is a Ford 4.6 L, spark ignition, four-stroke, eight-cylinder V configuration engine. Features of this engine include an overhead camshaft, a cross-flow fast-burn cylinder head design, two valves per cylinder and electronic port fuel injection. It is based on the Ford Motor Co. 4.6 L EFI Crown Victoria passenger car engine. In certain embodiments, the engine oil compositions described herein meet or exceed one or more of the GF-5 limits set for certain Sequence VG testing procedures. In certain embodiments, the formulations meet or exceed all of the GF-5 performance limits described herein.

In certain embodiments, the composition may exhibit an average engine sludge (merits) rating of ≥8, ≥10, ≥12, ≥13, ≥14, or ≥15. In certain embodiments, the compositions described may exhibit an average engine sludge (merits) of about 8 to about 20, such as about 8.5 to about 15, about 9 to about 13, or even about 9.5 to about 12.5.

In certain embodiments, the composition may exhibit an average rocker cover sludge (merits) rating of ≥8.3, ≥8.5, ≥9, ≥9.5, ≥10, or ≥11. In certain embodiments, the compositions described may exhibit an average rocker cover sludge (merits) of about 8.3 to about 12, such as about 8.5 to about 11, about 8.8 to about 10, or even about 9 to about 9.5.

In certain embodiments, the composition may exhibit an average engine varnish (merits) rating of ≥8.9, ≥9.2, ≥9.5, ≥9.8, ≥10, or ≥10.5. In certain embodiments, the compositions described may exhibit an average engine varnish (merits) of about 8.9 to about 12, such as about 9.1 to about 10.5, about 9.3 to about 10, or even about 9.5 to about 9.8.

In certain embodiments, the composition may exhibit an average piston skirt varnish (merits) rating of ≥7.5, ≥7.7, ≥8, ≥8.2, ≥8.5, or ≥9. In certain embodiments, the compositions described may exhibit an average piston skirt varnish (merits) of about 7.5 to about 12, such as about 7.8 to about 10, about 8 to about 9.5, or even about 8.2 to about 8.8.

In certain embodiments, the composition may exhibit an oil screen sludge (% area) rating of 15% or less, such as ≤13%, ≤11%, ≤8%, ≤7%, or even ≤5%. In certain embodiments, the compositions described may exhibit an oil screen sludge (% area) of about 0.1% to about 15%, such as about 2% to about 13%, about 4% to about 11%5, or even about 6% to about 9%.

In certain embodiments, the composition may exhibit an oil screen debris (% area) rating of 15% or less, such as ≤13%, ≤11%, ≤8%, ≤7%, or even ≤5%. In certain embodiments, the compositions described may exhibit an oil screen debris (% area) of about 0.1% to about 15%, such as about 2% to about 13%, about 4% to about 11%5, or even about 6% to about 9%.

In certain embodiments, the composition may exhibit no hot stuck compression rings and/or cold stuck rings. In certain embodiments, the composition may exhibit an oil ring clogging (% area) rating of 15% or less, such as ≤13%, ≤11%, ≤8%, ≤7%, or even ≤5%. In certain embodiments, the compositions described may exhibit an oil ring clogging (% area) of about 0.1% to about 15%, such as about 2% to about 13%, about 4% to about 11%5, or even about 6% to about 9%.

The Sequence IVA is a fired engine test designed to evaluate a candidate oil's performance in valvetrain wear. For GF-5, the performance parameters are evaluated per ASTM Method D6891 for a lubricant's ability to protect against cam lobe wear for overhead valve train equipped engines with sliding cam followers. The Sequence IVA uses a Nissan KA24E engine: 24 L displacement, water-cooled, fuel-injected, four cylinder in-line overhead camshaft. In certain embodiments, the engine oil compositions described herein meet or exceed one or more of the GF-5 limits set for certain Sequence IVA testing procedures. In certain embodiments, the formulations meet or exceed all of the GF-5 performance limits described herein. In certain embodiments, the compositions described herein exhibit an average cam wear (7 position average, μm) of 90 or less, such as ≤50, ≤30, ≤25, ≤15, ≤10, or even ≤5. In certain embodiments, the compositions described may exhibit an cam wear (7 position average, μm) of about 0 to about 90, such as about 0.1 to about 30, about 0.4 to about 25, about 0.6 to about 10, about 0.8 to about 5, or even about 1 to about 2.

The Sequence VIII is a fired engine test designed to evaluate a candidate oil's performance in bearing corrosion and shear stability. For GF-5, the performance parameters are evaluated per ASTM Method D6709 for a lubricant's ability to protect engines against bearing weight loss. This method covers SAE grades 5W, 10W, 20, 30, 40, and 50, as well as multi-viscosity grades, used in spark ignition engines. An oil is evaluated for its ability to protect the engine and oil from deterioration under high-temp and severe service conditions. The Sequence VIII uses a carbureted, spark ignition Cooperative Lubrication Research oil test engine run on unleaded fuel. In certain embodiments, the engine oil compositions described herein meet or exceed one or more of the GF-5 limits set for certain Sequence VIII testing procedures. In certain embodiments, the formulations meet or exceed all of the GF-5 performance limits described herein.

In certain embodiments, the compositions described herein exhibit a 10-hour stripped kinematic viscosity (@ 100° C., cSt) of 9.3 or more, such as ≥9.4, ≥9.5, ≥9.8, ≥10, ≥10.2, or even ≥10.5. In certain embodiments, the compositions described may exhibit a 10-hour stripped kinematic viscosity (@ 100° C., cSt) of about 9.3 to about 15, such as about 9.4 to about 11, about 9.5 to about 10.5, or even about 9.8 to about 10.2.

The Sequence VID is a fired engine test designed to evaluate a candidate oil's effect on fuel efficiency. For GF-5, the performance parameters are evaluated per ASTM Method D7589 for the effects of automotive engine oils on the fuel economy of passenger cars and light-duty (3856 kg, 8500 pounds or less gross vehicle weight) trucks. The Sequence VID uses a 2008 3.6 L V6 General Motors gasoline engine equipped with an external oil heating/cooling system and a "flying flush" system for changing oils without an engine shutdown is used for this test. In certain embodiments, the engine oil compositions described herein meet or exceed one or more of the GF-5 limits set for certain Sequence VID testing procedures. In certain embodiments, the formulations meet or exceed all of the GF-5 performance limits described herein.

In certain embodiments, the compositions described herein (SAE 5W-30 viscosity grade) exhibit an FEI summary of at least 1.9% after 60 hours. In certain embodiments, the compositions described herein (SAE 5W-30 viscosity grade)

exhibit an FEI after 60 hours of aging (%) of at least 1.9, such as ≥1.9, ≥2, ≥2.5, ≥3, ≥3.5, or even ≥4. In certain embodiments, the compositions described herein (SAE 5W-30 viscosity grade) exhibit an FEI after 60 hours of aging (%) of about 1.9 to about 5, such as about 2 to about 4.5, about 2.5 to about 4, or even about 3 to about 3.5.

In certain embodiments, the compositions described herein (SAE 5W-30 viscosity grade) exhibit an FEI summary of at least 0.9% after 100 hours. In certain embodiments, the compositions described herein (SAE 5W-30 viscosity grade) exhibit an FEI 2 after 100 hours of aging (%) of at least 0.9, such as ≥0.9, ≥1, ≥1.2, ≥1.5, ≥2, or even ≥2.5. In certain embodiments, the compositions described herein (SAE 5W-30 viscosity grade) exhibit an FEI 2 after 100 hours of aging (%) of about 0.9 to about 3, such as about 1 to about 2.5, about 1.2 to about 2.2, or even about 5 to about 2.

In certain embodiments, the compositions described herein meet or exceed the standards set forth in the USDA's BioPreferred Program for motor oils, which is currently set at a minimum of 25% bio-based content, as determined using ASTM Method D6866. In certain embodiments, the composition will exhibit a bio-based content of at least 30%, at least 35%, at least 40%, at least 50%, at least 60%, at least 75%, at least 85%, or even at least 90%. In certain embodiments, the engine oil composition will exhibit a bio-based content of about 25% to about 90%, such as about 25% to about 85%, about 25% to about 75%, about 25% to about 65%, about 25% to about 50%, about 25% to about 35%, or even about 30% to about 45%.

In certain embodiments, one or more of the optional additives discussed herein, such as certain metal deactivator packages, may comprise a fatty acid or fatty acid derivative or precursor, which may increase the acid value (e.g., total acid number) of the composition. Without being bound to any particular theory, in certain embodiments, it is believed that increasing the acid value of the composition may result in decreased oxidative stability of the composition, and thus adversely affecting results of tests conducted according to Sequence IIIG. Accordingly, in certain embodiments, the composition will be substantially free of fatty acid components, such as free fatty acids, and/or have a low acid value.

In certain embodiments is described a method of preparing an estolide composition, said method comprising selecting an estolide base oil; reducing the acid value of the estolide base oil to provide a low-acid estolide base oil; and combining the low-acid estolide base oil with at least one antioxidant. In certain embodiments, reducing the acid value of the estolide base oil to provide a low-acid estolide base oil comprises contacting said estolide base oil with at least one acid-reducing agent. In certain embodiments, the at least one acid-reducing agent is selected from any suitable agent, such as, for example, one or more of activated carbon, magnesium silicate (e.g., Magnesol®), aluminum oxide (e.g., Alumina), silicon dioxide, a zeolite, a basic resin, and an anionic exchange resin. In certain embodiments, the acid value of the at least one estolide base oil is reduced to any of the levels described herein, such as about 0.1 mg KOH/g or lower. In certain embodiments, the combination of the low-acid estolide base oil and the at least one antioxidant will have a time value similar to the times described herein for other estolide base oils when tested in a rotating pressurized vessel oxidation test using ASTM Method 2272-11, such as about 500 minutes, about 600 minutes, about 700 minutes, about 800 minutes, about 900 minutes, or even about 1000 minutes or more.

In certain embodiments, the composition comprises, or consists essentially of, an estolide base oil, a detergent inhibitor, and optionally an antioxidant. In certain embodiments, the engine oil composition further comprises a non-estolide base oil and/or a viscosity modifier. In certain embodiments, the non-estolide base oil comprises at least one mineral oil or semi-synthetic oil. Accordingly, in certain embodiments, the engine oil composition will exclude synthetic base oils such as PAOs and/or non-estolide synthetic esters. In certain embodiments, the engine oil composition will exclude additional additives such as pour point depressants and/or polyalkylene glycols.

In certain embodiments, the compositions may be suitable for use as a two-cycle or four-cycle lubricant. In certain embodiments, the composition may be suitable for use as a passenger car motor oil (PCMO), a crankcase oil, a transmission fluid, or a gearbox oil. In certain embodiments, the composition does not comprise a fuel (e.g., internal combustion fuel such as gasoline or diesel), and is not intended to be mixed into a fuel. Thus, in certain embodiments, the composition does not comprise a two-cycle and/or diesel engine lubricant.

As illustrated below, compound 100 represents an unsaturated fatty acid that may serve as the basis for preparing the estolide compounds described herein.

Scheme 1

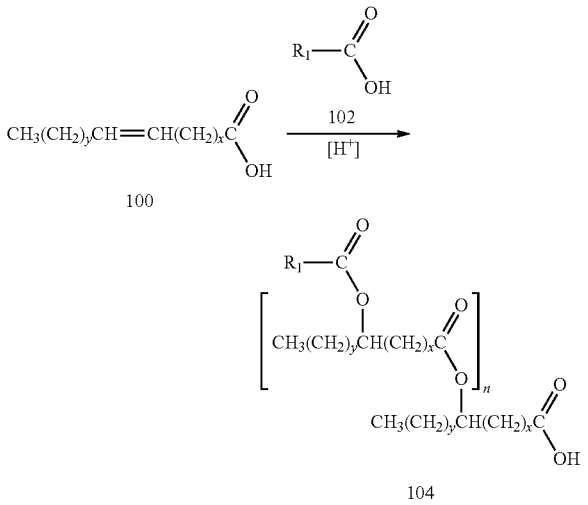

In Scheme 1, wherein x is, independently for each occurrence, an integer selected from 0 to 20, y is, independently for each occurrence, an integer selected from 0 to 20, n is an integer greater than or equal to 1, and $R_1$ is an optionally substituted alkyl that is saturated or unsaturated, and branched or unbranched, unsaturated fatty acid 100 may be combined with compound 102 and a proton from a proton source to form free acid estolide 104. In certain embodiments, compound 102 is not included, and unsaturated fatty acid 100 may be exposed alone to acidic conditions to form free acid estolide 104, wherein $R_1$ would represent an unsaturated alkyl group. In certain embodiments, if compound 102 is included in the reaction, $R_1$ may represent one or more optionally substituted alkyl residues that are saturated or unsaturated and branched or unbranched. Any suitable proton source may be implemented to catalyze the formation of free acid estolide 104, including but not limited to homogenous acids and/or strong acids like hydrochloric acid, sulfuric acid, perchloric acid, nitric acid, triflic acid, and the like.

Scheme 2

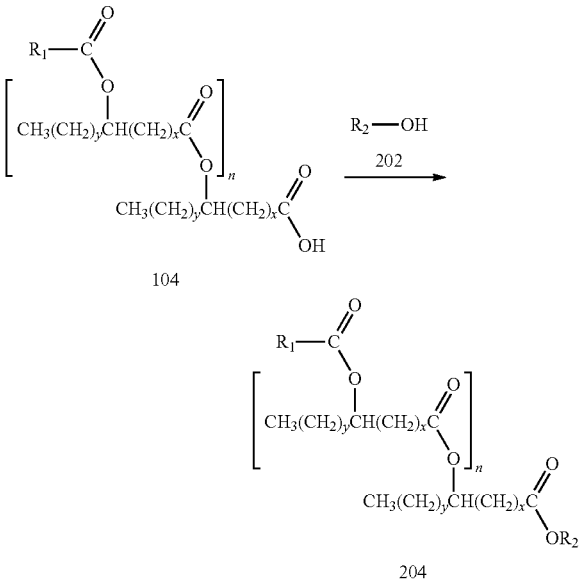

Similarly, in Scheme 2, wherein x is, independently for each occurrence, an integer selected from 0 to 20, y is, independently for each occurrence, an integer selected from 0 to 20, n is an integer greater than or equal to 1, and $R_1$ and $R_2$ are each an optionally substituted alkyl that is saturated or unsaturated, and branched or unbranched, free acid estolide 104 may be esterified by any suitable procedure known to those of skilled in the art, such as acid-catalyzed reduction with alcohol 202, to yield esterified estolide 204. Other exemplary methods may include other types of Fischer esterification, such as those using Lewis acid catalysts such as $BF_3$.

In all of the foregoing examples, the compounds described may be useful alone, as mixtures, or in combination with other compounds, compositions, and/or materials.

Methods for obtaining the novel compounds described herein will be apparent to those of ordinary skill in the art, suitable procedures being described, for example, in the examples below, and in the references cited herein.

EXAMPLES

Analytics

Nuclear Magnetic Resonance: NMR spectra were collected using a Bruker Avance 500 spectrometer with an absolute frequency of 500.113 MHz at 300 K using $CDCl_3$ as the solvent. Chemical shifts were reported as parts per million from tetramethylsilane. The formation of a secondary ester link between fatty acids indicating the formation of estolide was verified with $^1H$ NMR by a peak at about 4.84 ppm.

Estolide Number (EN): The EN was measured by GC analysis.

Iodine Value (IV): The iodine value is a measure of the total unsaturation of an oil. IV is expressed in terms of centigrams of iodine absorbed per gram of oil sample. Therefore, the higher the iodine value of an oil the higher the level of unsaturation is of that oil. Estimated by GC analysis.

Gas Chromatography (GC): GC analysis was performed to evaluate the estolide number (EN) and iodine value (IV) of the estolides. This analysis was performed using an Agilent 6890N series gas chromatograph equipped with a flame-ionization detector and an autosampler/injector along with an SP-2380 30 m×0.25 mm i.d. column.

The parameters of the analysis were as follows: column flow at 1.0 mL/min with a helium head pressure of 14.99 psi; split ratio of 50:1; programmed ramp of 120-135° C. at 20° C./min, 135-265° C. at 7° C./min, hold for 5 min at 265° C.; injector and detector temperatures set at 250° C.

Measuring EN and IV by GC: To perform this analysis, the fatty acid components of an estolide sample were reacted with MeOH to form fatty acid methyl esters by a method that left behind a hydroxy group at sites where estolide links were once present. Standards of fatty acid methyl esters were first analyzed to establish elution times.

Sample Preparation: To prepare the samples, 10 mg of estolide was combined with 0.5 mL of 0.5M KOH/MeOH in a vial and heated at 100° C. for 1 hour. This was followed by the addition of 1.5 mL of 1.0 M $H_2SO_4$/MeOH and heated at 100° C. for 15 minutes and then allowed to cool to room temperature. After which time, 1 mL of $H_2O$ and 1 mL of hexane were added to the vial and the resulting liquid phases were mixed thoroughly. The layers were then allowed to phase separate for 1 minute. The bottom $H_2O$ layer was removed and discarded. A small amount of drying agent ($Na_2SO_4$ anhydrous) was then added to the organic layer after which the organic layer was then transferred to a 2 mL crimp cap vial and analyzed.

EN Calculation: The EN is measured as the percent hydroxy fatty acids divided by the percent non-hydroxy fatty acids. As an example, a dimer estolide would result in half of the fatty acids containing a hydroxy functional group, with the other half lacking a hydroxyl functional group. Therefore, the EN would be 50% hydroxy fatty acids divided by 50% non-hydroxy fatty acids, resulting in an EN value of 1 that corresponds to the single estolide link between the capping fatty acid and base fatty acid of the dimer.

IV Calculation: The iodine value is estimated by the following equation based on ASTM Method D97 (ASTM International, Conshohocken, Pa.):

$$IV = \Sigma\ 100 \times \frac{A_f \times MW_I \times db}{MW_f}$$

$A_f$=fraction of fatty compound in the sample $MW_I$=253.81, atomic weight of two iodine atoms added a double bond db=number of double bonds on the fatty compound $MW_f$=molecular weight of the fatty compound The properties of the exemplary estolide base stocks and compositions are described herein are identified in Tables 1-3.

Other Measurements: Except as otherwise described, pour point is measured by ASTM Method D97, cloud point is measured by ASTM Method D2500, viscosity/kinematic viscosity is measured by ASTM Method D445, and viscosity index is measured by ASTM Method D2270.

Example 1

The acid catalyst reaction was conducted in a 50 gallon Pfaudler RT-Series glass-lined reactor. Oleic acid (65 Kg, OL 700, Twin Rivers) was added to the reactor with 70% perchloric acid (992.3 mL, Aldrich Cat#244252) and heated to 60° C. in vacuo (10 torr abs) for 24 hrs while continuously being agitated. After 24 hours the vacuum was released. 2-Ethylhexanol (29.97 Kg) was then added to the reactor and the vacuum was restored. The reaction was allowed to continue under the same conditions (60° C., 10 torr abs) for 4 more hours. At which time, KOH (645.58 g) was dissolved in 90% ethanol/water (5000 mL, 90% EtOH by volume) and added to the reactor to quench the acid. The solution was then allowed to cool for approximately 30 minutes. The contents of the reactor were then pumped through a 1μ filter into an accumulator to filter out the salts. Water was then added to the accumulator to wash the oil. The two liquid phases were thoroughly mixed together for approximately 1 hour. The solution was then allowed to phase separate for approximately 30 minutes. The water layer was drained and disposed of. The organic layer was again pumped through a 1μ filter back into the reactor. The reactor was heated to 60° C. in vacuo (10 ton abs) until all ethanol and water ceased to distill from solution. The reactor was then heated to 100° C. in vacuo (10 ton abs) and that temperature was maintained until the 2-ethylhexanol ceased to distill form solution. The remaining material was then distilled using a Myers 15 Centrifugal Distillation still at 200° C. under an absolute pressure of approximately 12 microns (0.012 torr) to remove all monoester material leaving behind estolides.

Example 2

The acid catalyst reaction was conducted in a 50 gallon Pfaudler RT-Series glass-lined reactor. Oleic acid (50 Kg, OL 700, Twin Rivers) and whole cut coconut fatty acid (18.754 Kg, TRC 110, Twin Rivers) were added to the reactor with 70% perchloric acid (1145 mL, Aldrich Cat#244252) and heated to 60° C. in vacuo (10 ton abs) for 24 hrs while continuously being agitated. After 24 hours the vacuum was released. 2-Ethylhexanol (34.58 Kg) was then added to the reactor and the vacuum was restored. The reaction was allowed to continue under the same conditions (60° C., 10 torr abs) for 4 more hours. At which time, KOH (744.9 g) was dissolved in 90% ethanol/water (5000 mL, 90% EtOH by volume) and added to the reactor to quench the acid. The solution was then allowed to cool for approximately 30 minutes. The contents of the reactor were then pumped through a 1μ filter into an accumulator to filter out the salts. Water was then added to the accumulator to wash the oil. The two liquid phases were thoroughly mixed together for approximately 1 hour. The solution was then allowed to phase separate for approximately 30 minutes. The water layer was drained and disposed of. The organic layer was again pumped through a 1μ filter back into the reactor. The reactor was heated to 60° C. in vacuo (10 torr abs) until all ethanol and water ceased to distill from solution. The reactor was then heated to 100° C. in vacuo (10 ton abs) and that temperature was maintained until the 2-ethylhexanol ceased to distill form solution. The remaining material was then distilled using a Myers 15 Centrifugal Distillation still at 200° C. under an absolute pressure of approximately 12 microns to remove all monoester material leaving behind estolides.

Example 3

The estolides produced in Example 2 were subjected to distillation conditions in a Myers 15 Centrifugal Distillation still at 300° C. under an absolute pressure of approximately 12 microns (0.012 ton). This resulted in a primary distillate having a lower EN average (Ex. 3A), and a distillation residue having a higher EN average (Ex. 3B).

Example 4

Estolides were prepared according to the method set forth in Example 2, except the reaction was initially charged with 41.25 Kg of Oleic acid and 27.50 Kg of whole cut coconut fatty acids, to provide an estolide product (Ex. 4).

Example 5

Estolides produced according to the method set forth in Example 4 (Ex. 4) were subjected to distillation conditions in a Myers 15 Centrifugal Distillation still at 300° C. under an absolute pressure of approximately 12 microns (0.012 ton). This resulted in a primary distillate having a lower viscosity (Ex. 5A), and a distillation residue having a higher viscosity (Ex. 5B).

Example 6

Estolides were prepared according to the methods set forth in Examples 4 and 5 to provide estolide products of Ex. 4, Ex. 5A, and Ex. 5B, which were subsequently subjected to a basic anionic exchange resin wash to lower the estolides' acid value: separately, each of the estolide products (1 equiv) were added to a 30 gallon stainless steel reactor (equipped with an impeller) along with 10 wt. % of Amberlite™ IRA-402 resin. The mixture was agitated for 4-6 hrs, with the tip speed of the impeller operating at no faster than about 1200 ft/min. After agitation, the estolide/resin mixture was filtered, and the recovered resin was set aside. Properties of the resulting low-acid estolides are set forth below in Table 1, which are labeled Ex. 4*, Ex. 5A*, and Ex. 5B*.

Example 7

Estolides were prepared according to the methods set forth in Examples 4 and 5. The resulting Ex. 5A and 5B estolides were subsequently hydrogenated via 10 wt. % palladium embedded on carbon at 75° C. for 3 hours under a pressurized hydrogen atmosphere to provide hydrogenated estolide compounds (Ex. 7A and 7B, respectively). The hydrogenated Ex. 7 estolides were then subjected to a basic anionic exchange resin wash according to the method set forth in Example 6 to provide low-acid estolides (Ex. 7A* and 7B*). The properties of the resulting low-acid Ex. 7A* and 7B* estolides are set forth below in Table 1.

TABLE 1

| Estolide Base Stock | EN | Pour Point ° C. (ASTM D97) | Cloud Point ° C. (ASTM D2500) | Viscosity 40° C. (ASTM D445) | Viscosity 100° C. (ASTM D445) | Viscosity Index (ASTM D2270) | Iodine Value |
|---|---|---|---|---|---|---|---|
| Ex. 2 | 1.82 | −33 | −32 | 65.4 | 11.3 | 167 | 13.2 |
| Ex. 1 | 2.34 | −40 | −33 | 91.2 | 14.8 | 170 | 22.4 |
| Ex. 3A | 1.31 | −30 | −30 | 32.5 | 6.8 | 175 | 13.8 |
| Ex. 3B | 3.22 | −36 | −36 | 137.3 | 19.9 | 167 | 9.0 |
| Ex. 4* | 1.86 | −29 | −36 | 52.3 | 9.6 | 170 | 12 |
| Ex. 5A* | 1.31 | −27 | −30 | 35.3 | 7.2 | 172 | 13 |
| Ex. 5B* | 2.94 | −33 | −36 | 137.3 | 19.9 | 167 | 7 |
| Ex. 7A* | 1.31 | −18 | −15 | 35.3 | 7.2 | 173 | <5 |
| Ex. 7B* | 2.94 | −27 | −24 | 142.7 | 20.9 | 171 | <5 |

Example 8

Various compositions were formulated and tested according to Sequence IIIG conditions for compliance ILSAC GF-5 standards. The formulations 1-9 are set forth in Table 2. Certain Sequence IIIG performance results of formulations 7-9, as compared to certain GF-5 standards, are set forth in Table 3.

TABLE 2

| Engine Oil Form. | Estolide Base Stock (%) | Non-Estolide Base Stock (%) | Viscosity Modifier (%) | PPD (%) | Detergent Inhibitor Additive (%) | Antiox. Booster (%) |
|---|---|---|---|---|---|---|
| 1 | Ex. 5A* (86.5) | — | SV277 (1) | (0.3) | P5710 (12.2) | — |
| 2 | Ex. 5A* (74.5) | PAO4 (10) | SV277 (3) | (0.3) | P5710 (12.2) | — |
| 3 | Ex. 5A* (64.5) | PAO4 (20) | SV277 (3) | (0.3) | P5710 (12.2) | — |
| 4 | Ex. 5A* (74.5) | Group III (10) | SV277 (3) | (0.3) | P5710 (12.2) | — |
| 5 | Ex. 5A* (64.5) | Group III (20) | SV277 (3) | (0.3) | P5710 (12.2) | — |
| 6 | Ex. 5A* (64.5) | Group II (20) | SV277 (3) | (0.3) | P5710 (12.2) | — |
| 7 | Ex. 5A* (64) | PAO4 (20) | SV277 (3.5) | (0.3) | P5710 (12.2) | — |
| 8 | Ex. 5A* (60) | PAO4 (23.092) | SV277 (3.5) | (0.3) | P5710 (12.158) | Aminic antiox. (0.95) |
| 9 | Ex. 7A* (35) | Yubase 4 (22.95) Yubase 6 (25.20) | SV277 (3.5) | — | P5710 (12.2) | Aminic antiox. (1.15) |

TABLE 3

| IIIG Merits | GF-5 Limits | 7 | 8 | 9 |
|---|---|---|---|---|
| ACLWFNL Wear Rating (μm) | 60 max. | 68.3 | 61.6 | 12.1 |
| PVISFNL Viscosity Increase (% @ 40° C.) | 150 max. | 436.2 | 230.9 | 56.5 |
| Weighted Piston Deposit (merits) | 4 min. | 7.21 | 8.44 | 8.46 |
| Hot Stuck Rings | None | 1 | None | None |
| IIIGB - Phos. Retention | 79% min. | 94 | 92.5 | 85.7 |
| IIIGA - Used Oil MRV | <60,000 cP @ −30° C. | 197,000 cP @ −30° C. | 58,000 cP @ −30° C. | 24,000 cP @ −30° C. |
| IIIGA - Used Oil CCS | <7,000 cP @ −25° C. | — | — | 6,180 cP @ −25° C. |
| Bio-Content (USDA Biopreferred Program) | 25% min. | 52.5% | 49.2% | 28.7% |
| Result | — | Fail | Fail | Pass |

Example 9

Formulation 9 (as set forth in Table 2) was tested according to Sequence IVA and Sequence VIII conditions for compliance ILSAC GF-5 standards. The results of those tests, as compared to certain GF-5 standards, are set forth in Tables 4 and 5.

TABLE 4

| IVA Merits | GF-5 Limits | Formulation 9 |
|---|---|---|
| Average cam wear, 7 position average (μm) | 90 max. | 1.06 |
| Result | — | Pass |

TABLE 5

| VIII Merits | GF-5 Limits | Formulation 9 |
|---|---|---|
| Bearing weight loss (mg) | 26 max. | 20.5 |
| 10-hr stripped KV @ 100° C. (cSt) | 9.3 min. | 9.52 |
| Result | — | Pass |

Example 10

Estolides were prepared according to the method set forth in Example 2, except the initial charging of oleic acid and whole cut coconut fatty acids was altered to provide two different estolide compositions having viscosities in the range of about 6 cSt to about 7 cSt. The resulting estolide products were subjected to distillation conditions in a Myers 15 Centrifugal Distillation still at 300° C. under an absolute pressure of approximately 12 microns (0.012 ton). This resulted in two separate primary distillates having a lower viscosities (Ex. 10A, 10B), and a distillation residues having higher viscosities (Ex. 10C, 10D). The Ex. 10A and 10B estolides were subsequently hydrogenated via 10 wt. % palladium embedded on carbon at 75° C. for 3 hours under a pressurized hydrogen atmosphere to provide hydrogenated estolide compounds. The hydrogenated Ex. 10A and 10B estolides were then subjected to a basic anionic exchange resin wash according to the method set forth in Example 6 to provide low-acid estolides (Ex. 10A* and 10B*). The properties of the resulting low-acid Ex. 10A* estolides included a kinematic viscosity of 6.8 cSt @ 100° C. and an EN of less than 1.5, while the low-acid Ex 10B* estolides exhibited properties that included a kinematic viscosity of 6.3 cSt @ 100° C. and an EN of less than 1.5.

Example 11

The composition of formulation 9 was prepared as set forth in Table 2, except the Ex. 7A* estolides were replaced with Ex. 10A* estolide and Ex. 10B* estolides (formulations 11A and 11B, respectively). The resulting formulations were tested according to Sequence VID conditions (ASTM D7589) for compliance with ILSAC GF-5 resource conserving standards. The results of those tests, as compared to GF-5 standards, are set forth in Table 6.

TABLE 6

| VID Merits (FEI XW-30 viscosity grade) | GF-5 Limits | Test #1 (11A) | Test #2 (11A) | Test #3 (11A) | Test #4 (11A) | Test #5 (11B) |
|---|---|---|---|---|---|---|
| FEI sum after 60 hrs aging | 1.9% min. | 1.20% | 1.40% | 1.77% | 1.47% | 3.30% |
| FEI sum after 100 hrs aging | 0.9% min. | 0.36% | 0.29% | 0.52% | 0.57% | 1.73% |
| Result | — | Fail | Fail | Fail | Fail | Pass |

The invention claimed is:

1. A composition comprising:

(i) about 30% to about 40% by weight of an estolide base oil having a kinematic viscosity from about 5 to about 10 cSt at 100° C., said estolide base oil comprising at least one estolide compound selected from compounds of Formula I:

Formula I

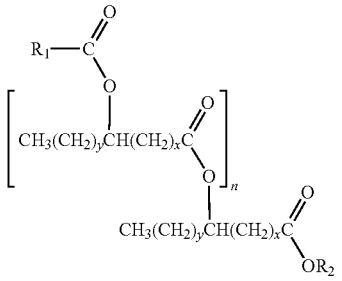

wherein x is, independently for each occurrence, an integer selected from 7 and 8;

y is, independently for each occurrence, an integer selected from 7 and 8;

n is an integer selected from 0, 1, and 2;

$R_1$ is an optionally substituted $C_1$ to $C_{22}$ alkyl that is saturated and unbranched; and $R_2$ is an optionally substituted $C_1$ to $C_{22}$ alkyl that is saturated and branched, wherein each fatty acid chain residue is unsubstituted;

(ii) about 40% to about 55% by weight of at least one synthetic hydrocarbon oil or semi-synthetic hydrocarbon oil;

(iii) about 5% to about 15% of at least one calcium sulfonate detergent inhibitor;

(iv) at least one antioxidant; and (v) at least 1% by weight of at least one styrene-type viscosity modifier, wherein the composition exhibits a wear rating of 60 μm or less, and a viscosity increase of 150% or less at 40° C., when tested according to ASTM Method 7320, wherein the estolide base oil has an iodine value of less than 10 cg/g, and wherein the composition has a bio-based content of at least 25% by weight when tested according to ASTM Method D6866.

2. The composition according to claim 1, comprising 30 to 40% by weight of the estolide base oil;

5 to 15% by weight of the at least one detergent inhibitor;

at least 0.1% by weight of the at least one antioxidant; and 2 to 5% by weight of at least one viscosity modifier; and 40 to 55% by weight of the at least one non-estolide base oil.

3. The composition according to claim 1, wherein the bio-based content of at least 25% by weight of the composition is derived from the estolide base oil.

4. The composition according to claim 1, wherein the composition exhibits a weighted piston deposit rating of at least 7 when tested according to ASTM Method 7320.

5. The composition according to claim 1, wherein the at least one viscosity modifier comprises a styrene-diene type polymer.

6. The composition according to claim 1, wherein the at least one detergent inhibitor comprises an overbased calcium sulfonate.

7. The composition according to claim 1 , wherein the at least one non-estolide base oil is a semi-synthetic oil comprising a Group III oil.

8. The composition according to claim 1, wherein the estolide base oil has an iodine value of less than 5 cg/g.

9. The composition according to claim 1, wherein the estolide base oil comprises about 35% by weight of the composition.

10. The composition according to claim 1, wherein the composition exhibits a wear rating of 0 to 30 μm or less when tested according to ASTM Method 7320.

11. The composition according to claim 1, wherein the composition exhibits a viscosity increase of 5 to 100% at 40° C. when tested according to ASTM Method 7320.

12. The composition according to claim 2, wherein the at least one antioxidant comprises 0.1 to 2% by weight of the composition.

* * * * *